US005130494A

United States Patent [19]

Simonton et al.

[11] Patent Number: 5,130,494

[45] Date of Patent: Jul. 14, 1992

[54] WORK SPACE WIRE MANAGEMENT SYSTEM

[75] Inventors: Ronald Simonton, Stonington; Mark G. Stasko, Woodstock Valley, both of Conn.; Michael Grant, Marietta, Ga.

[73] Assignee: Herman Miller, Inc., Zeeland, Mich.

[21] Appl. No.: 463,337

[22] Filed: Jan. 10, 1990

[51] Int. Cl.[5] ..... A47B 13/00

[52] U.S. Cl. ..... 174/48; 174/153 G; 108/23; 108/50; 312/195; 312/327; 312/223.1

[58] Field of Search ..... 174/48, 49, 65 G, 153 G; 312/194, 195, 223, 327, 328; 108/23, 50, 150; 52/36

[56] References Cited

U.S. PATENT DOCUMENTS

| | | | |
|---|---|---|---|
| 1,330,343 | 2/1920 | Purcell | 312/195 |
| 1,786,823 | 12/1930 | Carrington et al. | 312/194 |
| 2,240,767 | 5/1941 | Friedel | 312/195 |
| 2,387,506 | 10/1945 | Freeman | 312/195 |
| 2,853,351 | 9/1958 | Bassett | 312/194 |
| 2,856,252 | 10/1958 | Herring | 312/194 |
| 2,928,703 | 3/1960 | Paulsen | 312/194 X |
| 3,000,682 | 9/1961 | Loew et al. | 312/194 |
| 3,105,726 | 10/1963 | Jung | 312/195 |
| 3,300,078 | 1/1967 | Stanback | 220/4.01 |
| 3,408,127 | 10/1968 | Vincens | 312/194 |
| 3,635,174 | 1/1972 | Ball et al. | 312/223 X |
| 3,783,175 | 1/1974 | Timmons | 174/48 |
| 3,784,272 | 1/1974 | Schreiber | 312/245 |
| 3,787,605 | 1/1974 | Van Gessell et al. | 174/48 |
| 3,856,371 | 12/1974 | Forsyth | 312/195 |
| 3,857,622 | 12/1974 | Mohr et al. | 312/265.6 |
| 3,883,196 | 5/1975 | Mohr et al. | 312/194 |
| 4,066,305 | 1/1978 | Gazarek | 312/195 |
| 4,090,754 | 5/1978 | Kavis | 312/196 |
| 4,097,100 | 6/1978 | Sauder | 312/265.6 |
| 4,103,981 | 8/1978 | Donahue et al. | 312/265.6 |
| 4,163,572 | 8/1979 | Benscoter | 285/121 |
| 4,163,867 | 8/1979 | Breidenbach | 174/48 |
| 4,206,956 | 6/1980 | Lydmar | 312/265.4 |
| 4,323,291 | 4/1982 | Ball | 312/194 |
| 4,366,341 | 12/1982 | van Riet | 174/48 |
| 4,642,418 | 2/1987 | Menchetti | 174/48 |
| 4,681,378 | 7/1987 | Hellman, III | 312/108 |
| 4,685,255 | 8/1987 | Kelley | 52/36 |
| 4,716,496 | 12/1987 | Fritsch | 361/391 |
| 4,828,513 | 5/1989 | Morrison et al. | 439/527 |
| 4,950,839 | 8/1990 | Quinn et al. | 174/48 |

*Primary Examiner*—Leo P. Picard
*Assistant Examiner*—David A. Tone
*Attorney, Agent, or Firm*—Varnum, Riddering, Schmidt & Howlett

[57] ABSTRACT

The invention is for a furniture article having a panel mounted adjacent to a rear side of a top of the article and adapted for movement toward the front of the furniture article thereby allowing access to space rearward of the furniture article from a position beneath the top.

30 Claims, 27 Drawing Sheets

WORK SPACE WIRE MANAGEMENT SYSTEM

BACKGROUND OF THE INVENTION

1. Field of the Invention

This invention relates to a work space wire management system and, more particularly, to a system for efficiently managing electrical and communications utilities associated with a work space having freestanding articles of furniture.

2. Description of the Related Art

1. Wire Management in Modular, Open-plan Office Arrangements

Office arrangements of the open-plan type are a frequently used technique for dividing otherwise large open areas into smaller, more functional work stations. Such systems generally involve a plurality of rigid rectangular space-dividing partitions and panels rigidly connected at their edge portions by panel connectors and arranged in a linear or angular array to subdivide the open area. Panel returns extend outwardly from the partitions at substantially right angles thereto, stabilize the same, and partially define the individual work stations. Vertical hanging intelligence in the form of a plurality of vertically elongated slots is provided in the partition side edges or the panel connectors. Modular components such as work surfaces and storage compartments are engaged with the vertical hanging intelligence and suspended from the partitions in cantilevered fashion.

Myriad electrical and communications devices such as computers, video display units, and associated peripheral equipment; telephones, interoffice communication systems, and the like; typewriters; calculators; dictaphones; lighting; clocks; radios; etc., can be associated with the work station. It has been long recognized that a more organized, efficient, aesthetic and comfortable work station can be created if an effective means for arranging, distributing and managing the numerous electrical and communications cables associated with the aforementioned myriad of equipment is provided. Consequently, design efforts have focused on concealing the wiring within hidden yet accessible tracks, channels, raceways, recesses and so on. Similarly, work top grommets for selectively accessing cables routed beneath the work top have been developed.

2. Wire Management in Freestanding Furniture Arrangements

Despite the strides in wire management system development that have been made with regard to the modular, open-plan-type office arrangements described above, comparatively little emphasis has been placed on constructing analogous systems for use with free-standing furniture arrangements. In a freestanding furniture arrangement, various articles of furniture such as single- and double-pedestal desks, credenzas, returns, bookcases, breakfronts, component tables, peninsular runoffs and the like of nearly infinite variety are configured in an array, such as a U or C shape, conducive to the efficient management and organization of work. To the extent that such arrangements define secretarial and support staff work stations, the same myriad of electrical and communications equipment described above in connection with the modular office systems must be successfully incorporated into the freestanding furniture work station.

Furniture of the freestanding type is also used to furnish offices occupied by junior, mid-level, and executive management personnel who often have much of the same equipment affiliated with the support staff work stations installed in their own personal offices. This trend is increasing in that computer terminals and the like are more and more becoming a desktop tool for management.

However, the bundles of cables and wiring needed to power and supply the various electrical and communications devices have been left untended. They can easily clutter and disrupt an otherwise efficiently organized work space. Furthermore, numerous cables draped across work surfaces and snaking along floors are both unsightly and perhaps hazardous. They detract from the neat and professional appearance that businesses attempt to project. They may also create tripping hazards for workers, passersby, guests and so on. Although it was recognized some two decades ago that a solution to these deficiencies was needed for modular, open-plan-type office arrangements, comparatively little emphasis has been focused on resolving these same wants in the context of a freestanding furniture arrangement.

Thus, there is a need for a wire management system that is adapted for use with freestanding articles of furniture of the type described above. For such a system to be commercially successful, it must not only be capable of effectively concealing the cables but must provide means for easily accessing the cables from work surface tops. Furthermore, the system must be adapted to route cables from one article of furniture to an adjacent article, such as a return adjacent a desk, in a relatively concealed manner. Moreover, the individual elements of the wire management system must be discrete and adapted to blend aesthetically with the rich, fine woods from which the freestanding furniture articles may be constructed and the handsomely appointed surrounding environments in which furniture of such quality is often found.

SUMMARY OF THE INVENTION

According to the invention, an article of furniture comprises a top having front and rear sides and opposite ends. The article of furniture comprises a panel and means for mounting the panel adjacent the rear side of the top for movement between a first position where the panel restricts access to space rearward of the article of furniture from a position beneath the top and a second position where the panel permits access to the space rearward of the article of furniture from a position beneath the top. The panel is adapted to be moved in a direction toward the front of the desk as the panel is disposed in the second position.

In another aspect of the invention, an article of furniture has an interior space and a panel separating the interior space of the article from the exterior. The panel has an opening for communication between the interior and the exterior, and a grommet is adapted to be received in the opening. The grommet comprises a sleeve adapted to be received with the opening and a cover removably mounted to the sleeve to cover the opening with the cover having opening means substantially concealed from view to permit wires to pass through the cover between the exterior and the interior. A closure member is pivotally mounted to the cover and has a pair of opposed walls connected by a web which define a channel. The opening means comprises the channel for conducting wires through the channel. The cover preferably has a wall portion complementary in shape to the sleeve and adapted to be slidably received within the sleeve.

In another aspect of the invention, the cover comprises a recessed portion connected angularly to a first wall, and the first wall and the recessed portion having a contiguous opening to form the opening means. A portion of the first wall is offset from the remainder of the first wall, and the offset portion partially defines the contiguous opening. The recessed portion has a removably connected section adjacent the contiguous opening to permit the contiguous opening to be enlarged when the section is removed. Preferably, this section is connected to the recessed portion by a frangible connection. The cover can further comprise a second wall angularly connected to the first wall at the offset portion and spaced from the contiguous opening to partially define the opening means and substantially conceal the opening means from view when the cover is mounted to the sleeve.

In another aspect of the invention, an article of freestanding furniture comprises desks, tables, credenzas, and the like and can be disposed adjacent another article. The article has horizontal and vertical panels defining an interior space and separating the interior space of the article from the exterior. The article comprises a wire management means for conducting electrical wires to electrical components associated with the article. An improvement in the wire management means comprises grommet means mounted to the vertical panel at an upper portion which defines an opening through the vertical panel for communication between the interior and the exterior. Channel means are mounted within the interior to one of the vertical panel and the horizontal panel substantially in axial alignment with the grommet means so that the grommet means and the channel means are adapted to receive an retain wires. The article of furniture preferably includes a second grommet means on the horizontal panel for passing wires from the channel means to the exterior through the horizontal panel.

In a further aspect of the invention, a wire management system is provided for at least two articles of freestanding furniture of the type comprising desks, tables, credenzas, and the like. The articles are such that they can be disposed adjacent one another, and each of the articles has horizontal and vertical panels defining an interior space and separating the interior space from the exterior. The wire management system comprises a first grommet means mounted to a vertical panel in a first article which defines an opening for communication between the interior and the exterior of the article. Second grommet means are mounted to a vertical panel in a second article and define an opening for communication between the interior and the exterior of the article so that the first and second grommet means are adapted to receive and retain wires. The first grommet means is aligned with the second grommet means to permit wires to pass from the first article to the second article unobstructed and substantially concealed from view when the first article is placed in juxtaposition to the second article.

BRIEF DESCRIPTION OF THE DRAWINGS

The invention will now be described with reference to the drawings in which.

DETAILED DESCRIPTION OF THE PREFERRED EMBODIMENTS

Figure 1:
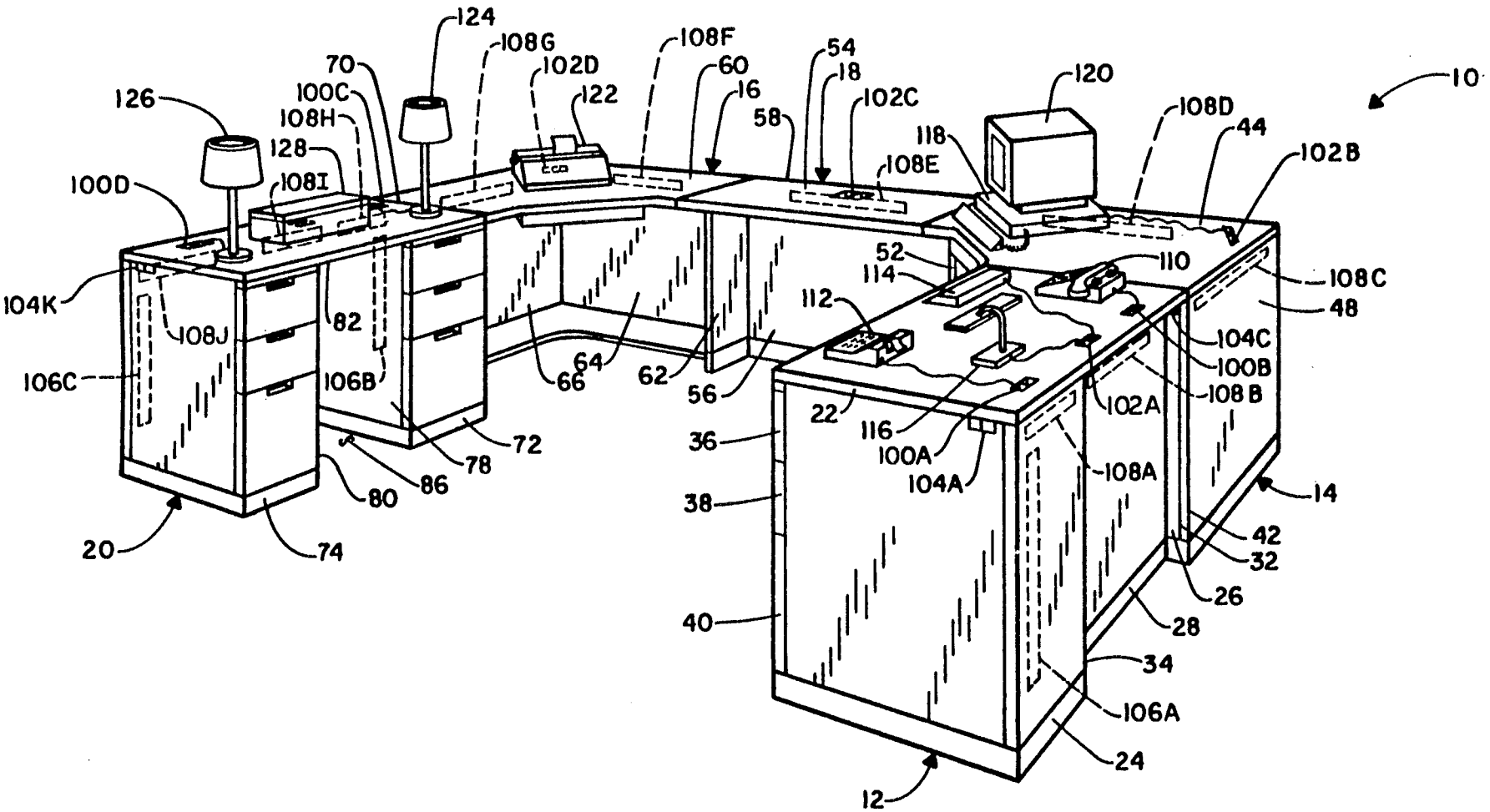
FIG. 1 is a perspective view of an arrangement of furniture incorporating a wire management system according to the invention.

1. Overview of a Freestanding Furniture Arrangement

Turning now to the drawings and in particular FIGS. 1 to 4, the invention for a wire management system is identified generally by the reference numeral 10 as is shown in conjunction with several articles of office furniture. The illustrated furniture articles include a single pedestal desk 12, a pair of component tables 14 and 16, a bridge 18 which spans between the component tables, and a credenza 20. The articles of furniture are arranged in a generally U- or C-shaped configuration, this being a common pattern for facilitating efficient management of work.

Oftentimes furniture such as that shown in the drawings is designed by the manufacturer as part of a line or family of furniture in which the individual furniture pieces are adapted to be used in conjunction with each other. For example, a desk, a credenza and a bookcase may be elements of a matching set of furniture. Although several furniture articles are indicated above, the invention is not limited to these articles or the U-shaped arrangement of FIGS. 1 to 4. The particular wire management features described below may be successfully incorporated into articles of furniture other than those shown, such as double-pedestal desks; desk returns; stand-up desks and work surfaces; bookcases, breakfronts and other stand-up storage units; component runoffs and other horizontal, generally unenclosed work surfaces; and pedestals and other freestanding enclosed storage units.

The desk 12 comprises a desk top or horizontal work surface 22; a pedestal 24 for supporting one end of the desk top; a vertical side or return panel 26 for supporting the opposite end of the desk top; and a movable modesty panel 28 mounted to an underside 30 of the desk top, an inside surface 32 of the return panel, and an interior wall 34 of the pedestal 24. The desk 12 further includes drawers 36, 38, and 40 which slidably reciprocate into and out of the pedestal 24 on drawer glides or other roller mechanisms (not shown specifically in the drawings). The underside 30 of the desk top 22, the inside surface 32 of the return panel 26 and the interior wall 34 of the pedestal 24 cooperate to define a knee space or kneehole 41 therebetween.

The component table 14 abuts an outside surface 42 of the desk return panel 26 and comprises a flat, horizontal upper component supporting surface 44, and a plurality of panel-like support legs 46, 48, 50 and 52 mounted to an underside 44*a* of the component supporting surface. The component table 14 can be used to support a computer terminal, cathode ray tube display unit or the like.

The bridge 18 comprises a flat upper work surface 54 and a pivoting modesty panel 56 depending from an edge 58 of the work surface and hingedly mounted to a base rail 59. The bridge 18 is supported by engaging opposite ends of the work surface 54 with the work surface 44 of the component table 14 and a horizontal work surface 60 of the component table 16. Conventional mechanical mounting hardware (not shown separately in the drawings) can be used to secure the bridge 18 to the tables 14 and 16. The component table 16 is substantially similar to the table 14 and further includes panel-like support legs 62, 64, 66 and 68.

The credenza 20 comprises a horizontal, flat, upper surface 70; a pair of pedestals 72 and 74 supporting opposite ends of the upper surface; and a movable modesty panel 76 mounted to an inside wall 78 of the pedestal 72, an inside wall 80 of the pedestal 74, and an underside 82 of the upper surface. Thus, the inside walls 78 and 80, respectively, of the pedestals 72 and 74, an inside surface 84 of the modesty panel 76, and the underside 82 of the upper surface 70 define a knee space or kneehole 86.

As will be explained in greater detail below, the wire management system 10 is formed of several elements that cooperate to define an efficient and effective means for distributing, arranging and accessing electrical and communications cables in a freestanding furniture arrangement. Although a particular arrangement of furniture is shown in FIGS. 1 to 4, it will be understood that this is merely for the purpose of describing one way in which the various elements may be combined to define a workable system. As explained below, the elements of the wire management system shown in FIGS. 1 to 4 can be incorporated into articles of furniture other than those shown to provide similar advantages. The individual articles of furniture can be configured into a virtually limitless variety of arrangements and are not solely restricted to the C-or U-shaped pattern illustrated. Moreover, the articles of furniture can be used alone and not in conjunction with related, auxiliary furniture pieces.

Each article incorporates several important features that provides it with independent wire management capability. To the extent that several articles of furniture are employed simultaneously, the particular arrangement selected will be determined by numerous parameters such as the dimensions of the space to be furnished, the number of articles of furniture, the size of the articles of furniture, the types of articles of furniture selected, inherent limitations in the space to be furnished such as the position of doors, windows, storage closets, plumbing fixtures and the like, as well as, and perhaps most important, the personal preferences of the user.

The significant elements of the wire management system 10 include wire management grommets of three types, respectively designated by the reference numerals 100, 102, and 104, pivotally mounted modesty panels, removably mounted pedestal backs, and wire management channels of two types, respectively 106 and 108. With reference to FIGS. 1 to 4, there are shown grommets, 100A to 100D, 102A to 102E, and 104A to 104K. Grommets identified by the reference numeral 100 without regard to the letter designation are substantially identical to each other, the letters serving merely to define different positional locations of the individual grommets within the wire management system 10. Thus, the grommet 100A is substantially identical to the grommets 100B, 100C and 100D. However, the grommets 100A and 100B are mounted to the desk top 22 whereas the grommets 100C and 100D are mounted to the flat upper surface 70 of the credenza 20.

Similarly, grommets identified by the reference numeral 102 are substantially identical to each other, the letters defining the positional location of an individual grommet within the wire management system 10. Thus, the grommet 102A is substantially similar to the grommets 102B, 102C and so on. However, the grommet 102A is mounted to the desk top 22, whereas the grommet 102B is mounted to the upper component supporting surface 44 of the component table 14, the grommet 102C is mounted to the flat work surface 54 of the bridge 18, and so on. Also, grommets identified by the reference numeral 104 are substantially identical to each other, the letters defining the position of an individual grommet within the wire management system 10. Thus, the grommet 104A is substantially identical to the grommets 104B, 104C and so on. However, the grommet 104A is mounted to an exterior wall of the desk pedestal 24, whereas the grommet 104B is mounted to an interior wall of the desk pedestal 24, the grommet 104C is mounted to the return panel 26 of the desk 12 and so on.

An analogous system of identification has been utilized with respect to the wire management channels 106 and 108. That is, each wire management channel that is identified by the reference numeral 106 is substantially identical to each other wire management channel similarly designated, the letters referring to different locations within the wire management system 10 for the individual wire management channels. Thus, the wire management channel 106A is substantially identical to the channels 106B and 106C. However, the channel 106A is mounted interiorly of the desk pedestal 24, whereas the channel 106B is mounted interiorly of the credenza pedestal 72, and the channel 106C is mounted interiorly of the credenza pedestal 74.

Similarly, the wire management channels 108A to 108J are substantially identical to each other, the letters designating different locations within the wire management system 10 for the individual wire management channels. Thus, the wire management channel 108A is substantially similar to the wire management channels 108B, 108C, and so on. However, the wire management channel 108A is mounted interiorly of the desk pedestal 24, the wire management channel 108B is mounted to the desk modesty panel 28, the wire management channel 108C is mounted to the leg 48 of the component table 14, and so on.

Associated with the furniture arrangement of FIGS. 1 to 4 are several electrical and communications devices for which the wire management system facilitates, use, installation, and arrangement. For example, a telephone and interoffice communication device 110, a calculator 112, a dictaphone 114, and a lamp 116 are associated with the desk 12. A computer 118 and related cathode ray tube display unit 120 are associated with the component table 14. An electric typewriter 122 is positioned on the component table 16. A pair of lamps 124 and 126 and stereophonic equipment 128 are associated with the credenza 20.

2. Wire Management Grommets

As shown in FIGS. 1 to 4, the grommet 100 is adapted for use with a substantially flat work surface such as the desk top 22. As noted above, the grommet 100A is substantially identical to the grommets 100B, 100C and so on, the letter designations merely identifying different locations of the individual grommets 100 within the wire management system 10.

The grommet 100 is best shown in FIGS. 5 to 10 and comprises generally a sleeve 200 and a removable cover member 202. The sleeve 200 (FIGS. 5 to 7) generally comprises a one-piece injection-molded component and includes a cylindrical sleeve wall 204 open at upper and lower ends 206 and 208, respectively, thereof. An exterior surface 210 of the sleeve wall 204 is provided with a plurality of wedging ribs 212 that decrease in height from the lower end 208 to the upper end 206 of the sleeve wall 204, the significance of which is explained below. Preferably, four equally spaced ribs 212 are provided. An interior surface 214 of the sleeve wall 204 includes at the upper end 206 thereof several, preferably four, equally spaced, shallow depressions 216 continuous with an upper edge 218 of the sleeve wall 204 and decreasing in depth in a direction toward the lower end 208 of the sleeve wall, the depressions eventually merging with the interior surface 214 of the sleeve wall. Mounted to the upper edge 218 of the sleeve wall 204 is a square retaining flange 220 having upper and lower surfaces 222 and 224, respectively.

Figure 8:
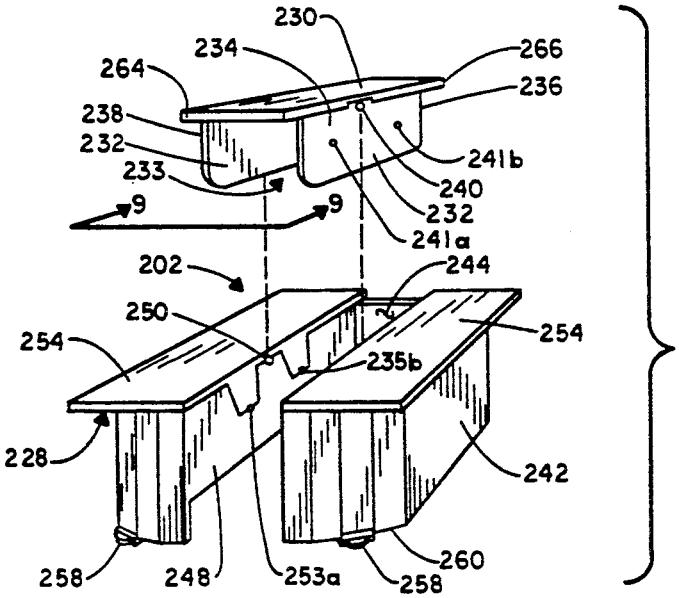
FIG. 8 is an exploded perspective view of a cover of the grommet of FIGS. 5, 5A, 5B and 6.
Figure 9:
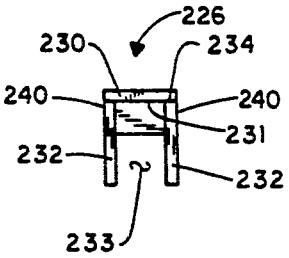
FIG. 9 is an elevational view taken along lines 9—9 of FIG. 8.
Figure 10:
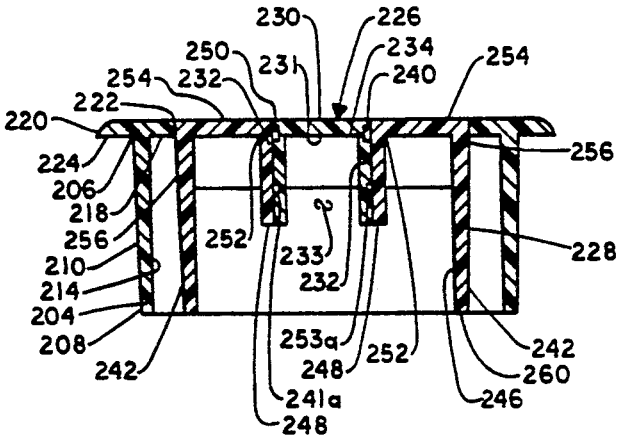
FIG. 10 is a sectional view taken along lines 10—10 of FIG. 5B.

The removable cover 202 is best shown in FIGS. 8 to 10 and includes a wire access arm or door 226 pivotally mounted to a hollow retainer 228. The arm 226 comprises a top wall 230 and a pair of pivot plates 232 depending from opposite sides of an underside 231 of the top wall, the top wall underside and the pivot plates defining a wiring channel 233 therebetween. Formed along an upper edge 234 of each plate 232, approximately midway between opposite ends 236 and 238 of the top wall 230, is a pivot mount 240. Also formed on each plate 232 in an approximately central location are a pair of spaced apart spur receiving recesses 241*a* and 241*b*.

The retainer 228 comprises a substantially circular base wall 242 having a wire access opening 244 formed therein. Secured to an inside surface 246 of the wall 242 are a pair of mounting plates 248 that extend across the open interior of the hollow retainer. Projecting outwardly from each plate 248 is a pivot 250 positioned near an upper edge 252 of the plate. Also projecting outwardly from each plate 248 and below the pivot 250 are a pair of spaced apart spurs 253*a* and 253*b*. Although the positions of the spur receiving recesses 241*a*, 241*b* and the spurs 253*a*, 253*b* can be reversed, it is preferred, for purposes of facilitating manufacturing, that they be oriented as shown in the drawings. A pair of spaced-apart top wall sections 254 are mounted to the upper edge 252 of each plate 248 and extend outwardly therefrom to be supported by an upper edge 256 of the base wall 242. A plurality of, preferably four, rounded tabs 258 extend laterally from a lower edge 260 of the base wall 242.

In assembly, the wire access arm 226 is pivotally mounted to the retainer 228. The pivot plates 232 of the arm 226 are received between the mounting plates 248 of the retainer 228 and the top wall 230 of the arm 226 is received between the top wall sections 254 of the retainer. The pivots 250 of the retainer 228 engage the pivot mounts 240 of the arm 226, and the spur receiving recesses 241*a* and 241*b* of the arm 226 receive, respectively, the spurs 253*a* and 253*b* of the retainer 228. The spacing between the top wall sections 254 of the retainer 228 is slightly less than the width of the top wall 232 of the arm 226. Thus, when the arm 226 is received by the retainer 228, the latter is resiliently expanded to securely retain the arm between the pair of retainer top wall sections 254 and the pair of retainer mounting plates 248. The cover 202 is received within the open interior of the sleeve 200, the rounded tabs 258 being received by the depressions 216 to guide the cover. Because the depressions 216 decrease in depth toward the lower end 208 of the sleeve wall 204, the base wall 242 of the retainer 228 is resiliently displaced inwardly until the tabs 258 clear the lower end of the sleeve wall 204 thereby allowing the base wall to expand and retain the cover 202 within the sleeve 200.

Figure 5:
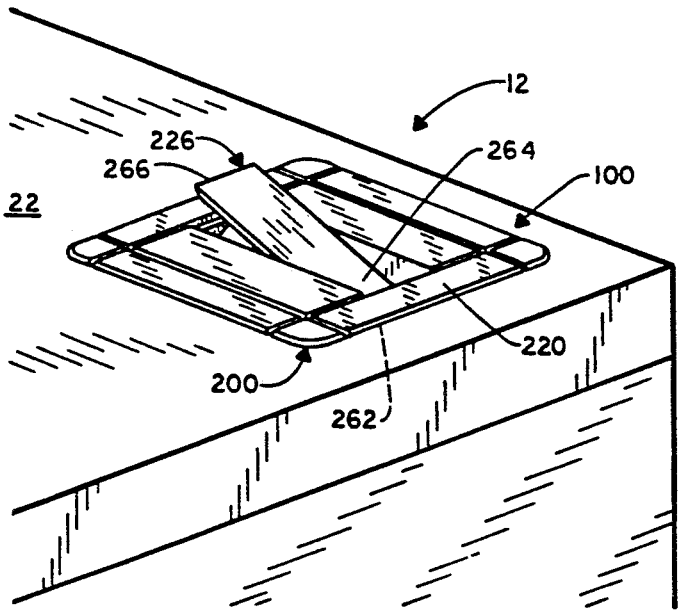
FIG. 5 is an enlarged fragmentary perspective view of a grommet of the wire management system mounted to an article of furniture.
Figure 5A:
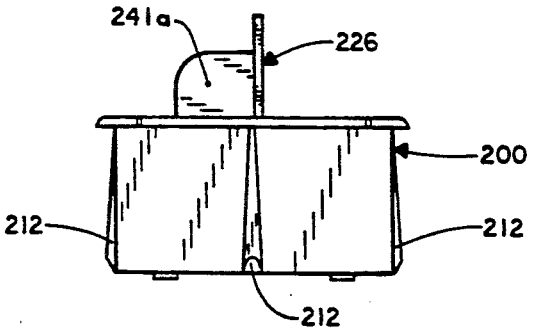
FIG. 5A is an elevational view of the grommet of FIG. 5 but showing a pivotally mounted arm thereof in an alternative position.
Figure 5B:
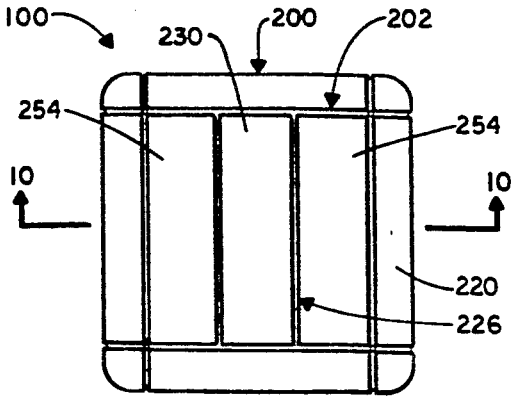
FIG. 5B is a top plan view of the grommet of FIGS. 5 and 5A but showing the pivotally mounted arm thereof in a closed position.
Figure 6:
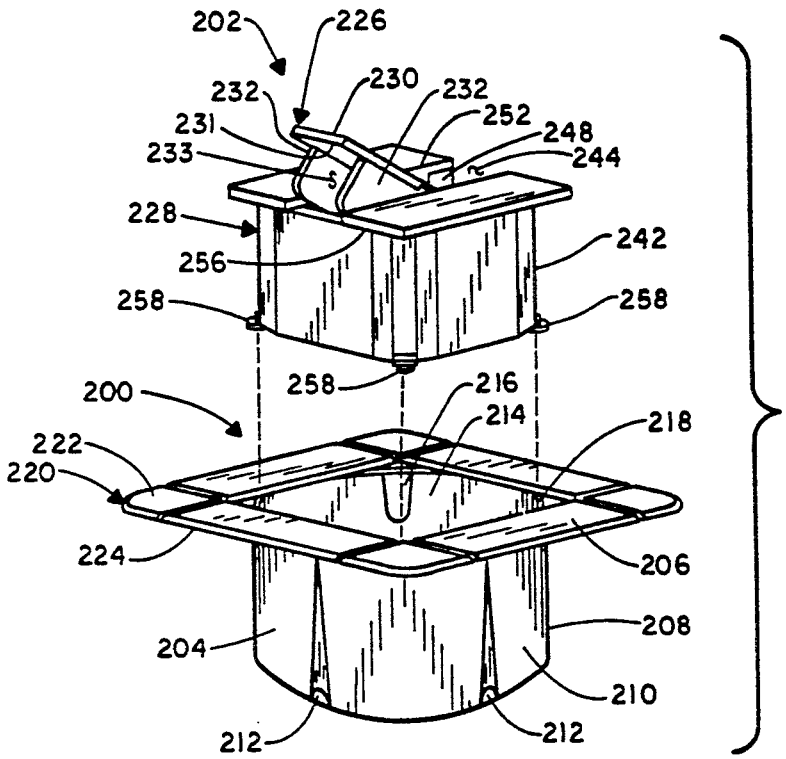
FIG. 6 is a partially exploded perspective view of the grommet of FIGS. 5, 5A and 5B.
Figure 7:
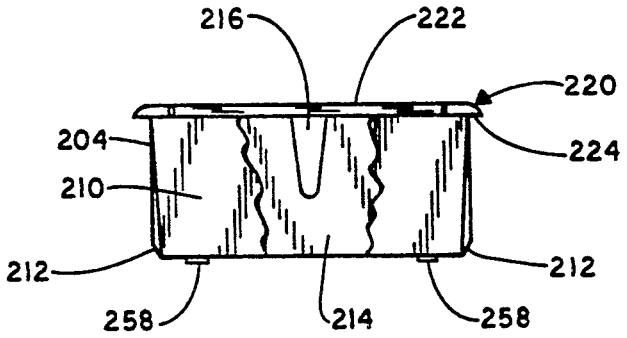
FIG. 7 is an elevational view of a sleeve of the grommet of FIGS. 5, 5A, 5B and 6 with a portion thereof broken away to show an interior of the sleeve.

As shown in FIGS. 5 and 6, the fully assembled grommet 100 is inserted within a circular opening 262 provided in a work surface top such as the desk top 22. If the grommet 100 is mounted over a pedestal, such as the grommet 100A mounted over the pedestal 24 of the desk 12, it is preferred that the grommet be oriented such that it is more or less centered, side by side, relative to the interior and exterior walls of the pedestal. The wedging ribs 212 bear against the interior wall of the opening 262 and accommodate slight variations in opening diameter. The lower surface 224 of the retaining flange 220 bears against the desk top 22. In operation, the arm 226 is pivotal with respect to the retainer 228. Depressing an end 264 of the arm 226 that overlies the opening 244 in the retainer base wall 242 causes an opposite end of the arm 266 to elevate as shown in FIG. 5, thereby placing the wire channel 233 in communication with the desk top 22. If desired, and as best shown in FIG. 5A, the wire access arm may be rotated to a vertical position in which the arm is substantially perpendicular to the desk top 22. The arm 226 is resiliently retained in the vertical position by the spurs and spur receiving recesses. More particularly, as the arm 226 is pivoted, the spurs 253*a* and 253*b* disengage from, respectively, the spur receiving recesses 241*a* and 241*b*. Upon rotation to the vertical orientation, the spurs 253*a* engage the spur receiving recesses 241*b*, the spur receiving recesses 241*a* projecting above the grommet top wall sections 254. In the preferred arrangement, the work surface opening 262 penetrates the entire thickness of the work surface thereby placing the channel 233 in communication with, for example, the knee space 41 of the desk 12 or the interior of the pedestal 24.

As explained more fully hereinbelow, cables are routed through the desk knee space 41 and may be brought to the desk top 22 by way of the wire channel 233 of the grommet 100. The grommet 100 is especially useful for managing, arranging and distributing cables supplying electrical and communication devices associated with the work surface of an article of furniture such as the telephone 110, the calculator 112, the dictaphone 114, and the lamp 116 that are associated with the desk top 22 of the desk 12. The pivoting wire access arm 226 is pivoted to elevate the same thereby making the wire management channel accessible. Because the wire access arm 226 is pivotally mounted, once the cable has been placed within the wire management channel 233, the arm 226 can be closed to the extent permitted by the cable thereby projecting the arm above the work surface only to the degree necessary. On the other hand, if the wire management capabilities of the grommet 100 are not required, the arm 226 can be pivoted to a closed position wherein it is substantially flush with the surrounding surface of the desk top 22, maintenance of the flush orientation being facilitated by the engagement of the spurs 253*a* and 253*b* with, respectively, the spur receiving recesses 241*a* and 241*b*.

Alternatively, the pivoting wire access arm 226 can be completely removed from the retainer 228 thus providing a wire access opening of a size larger than when the arm is pivoted, the opening being defined in substantial part by the space or wire access opening 244 between the retainer top wall sections 254, this, of course, being the space in which the pivoting arm 226 is normally received. If still a larger wire access opening is needed, the sleeve 200 of the grommet 100 can be mounted to the desk 12 without the cover 202, this being the largest wire opening possible with the grommet 100. To remove the retainer 228 from the cover 200 it is preferred that the arm 226 first be rotated to the substantially vertical position as described above and shown in FIG. 5A. In this orientation, a user may grasp that portion of the arm 226 projecting above the grommet top wall sections 254 and pull, thereby releasing the retainer 228 from the cover. The top wall sections 254 may then be forcibly yet resiliently displaced, thereby freeing the arm 226 from the retainer 228. The retainer 228 may then be replaced. Alternatively, a large plug end may be passed through the sleeve 200, the cable associated with the plug end positioned between the top wall sections 254, the arm 226 mounted to the retainer 228, and the cover 202 placed within the sleeve. Thus it can be seen that the size of the wire opening of the grommet 100 may be temporarily expanded to accommodate the passage of a large plug end through the grommet sleeve 200.

The grommet 102 is best shown in FIGS. 11, 11A to 11F, 12 to 16, and 16A to 16C and comprises a one-piece, injection-molded plastic retainer sleeve 280 and a pair of substantially identical one-piece, injection-molded plastic covers 282 received by the sleeve. As noted above, the grommet 102A is substantially identical to the grommets 102B, 102C and so on, the letter designation merely identifying the location of individual grommets 102 within the wire management system 10. Although a pair of covers 282 are shown in conjunction with the sleeve 280, the sleeve could be easily adapted to receive a single cover or more than two covers.

Figure 11:
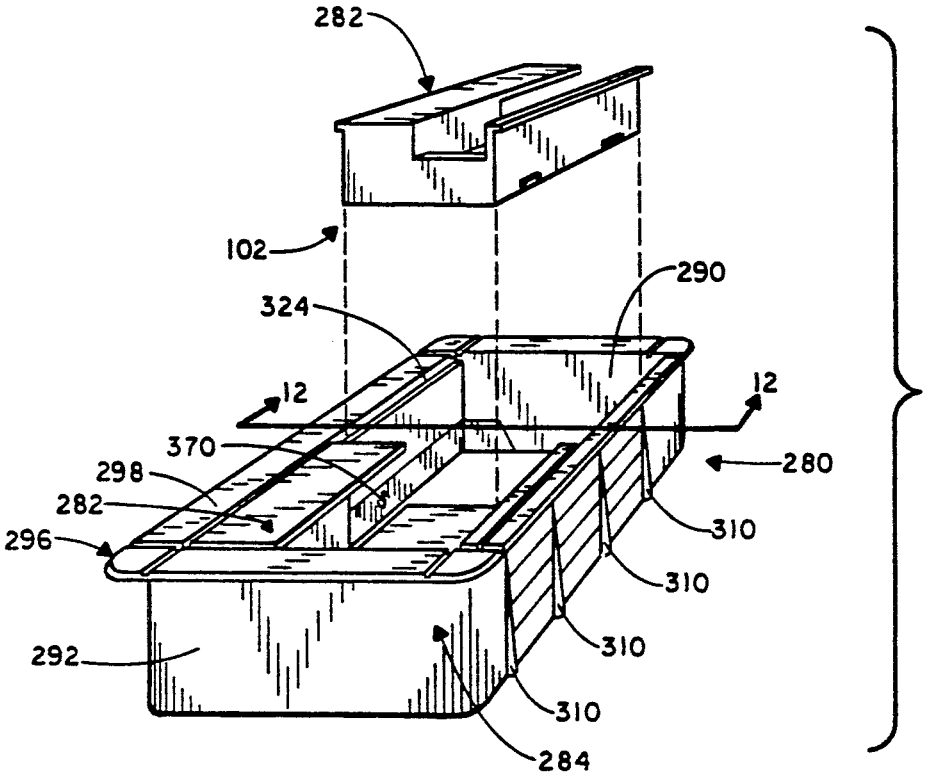
FIG. 11 is an exploded perspective view of a second grommet of the wire management system.
Figure 12:
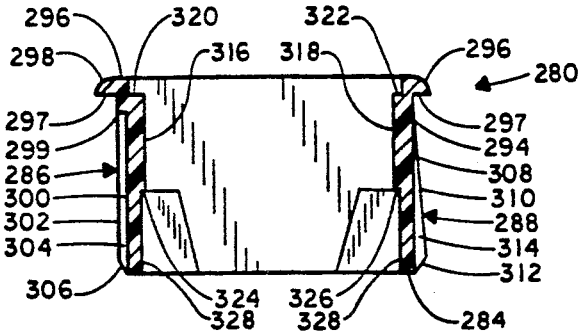
FIG. 12 is a sectional view taken along lines 12—12 of FIG. 11.
Figure 13:
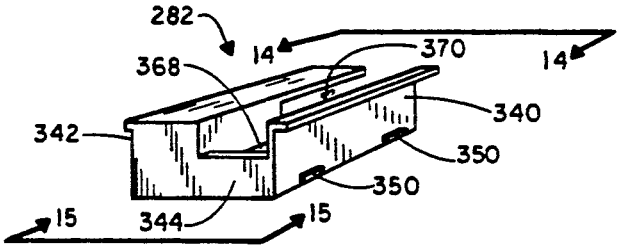
FIG. 13 is a perspective view of a cover of the grommet of FIGS. 11 to 11F.
Figure 14:
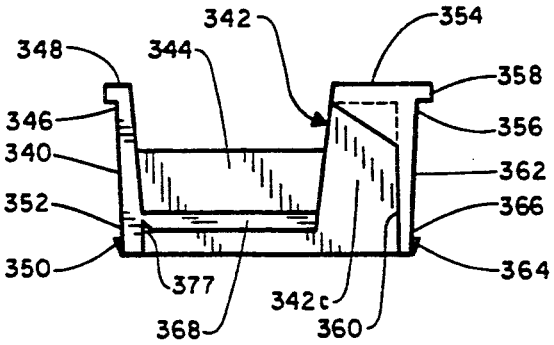
FIG. 14 is an end elevational view taken along lines 14—14 of FIG. 13.
Figure 15:
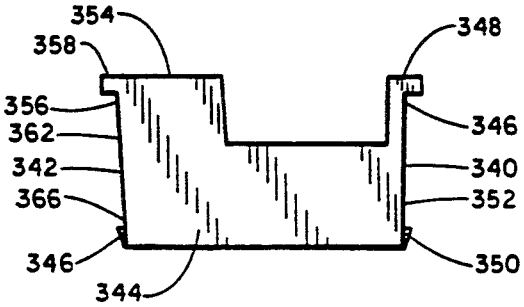
FIG. 15 is an end elevational view taken along lines 15—15 of FIG. 13.

The sleeve 280 is best shown in FIGS. 11 and 12 and comprises a generally hollow rectangular member having an open top and bottom. The retainer sleeve 280 includes a continuous wall member 284 formed of a pair of opposed side walls 286 and 288 and a pair of end walls 290 and 292. Continuous with an upper edge 294 of the wall member 284 is a flange 296 that extends laterally outwardly relative to the wall 284. The flange 296 includes an underside 297. The flange 296 is asymmetrical in the sense that flange portion 298 extends laterally outward relative to the side wall 286 a greater distance than does the flange 296 with respect to the side wall 288 and the end walls 290 and 292. To balance the asymmetry of the flange portion 298, a ridge 299 is formed on the side wall 286 adjacent to the flange underside 297, the ridge 299 merging smoothly with the sleeve end walls 290 and 292.

An exterior surface 300 of the side wall 286 is formed with a series of vertically-extending substantial ribs 302, lower ends 304 of which are chamfered as at 306. Similarly, an exterior surface 308 of the side wall 288 is provided with a series of vertically-extending, spindle-shaped ribs 310 that decrease in circumference in a direction toward the upper edge 294 of the wall member 284 and which have chamfers 312 at their lower ends 314. Interior surfaces 316 and 318 of the side walls 286 and 288, respectively, are substantially identical and include, respectively, rims 320 and 322 that are formed contiguous with the upper edge 294 of the wall member 284 and offset from the flange 296. The interior surfaces 316 and 318 further include, respectively, lips 324 and 326 formed intermediate the upper wall edge 294 and a lower wall edge 328.

Figure 19:
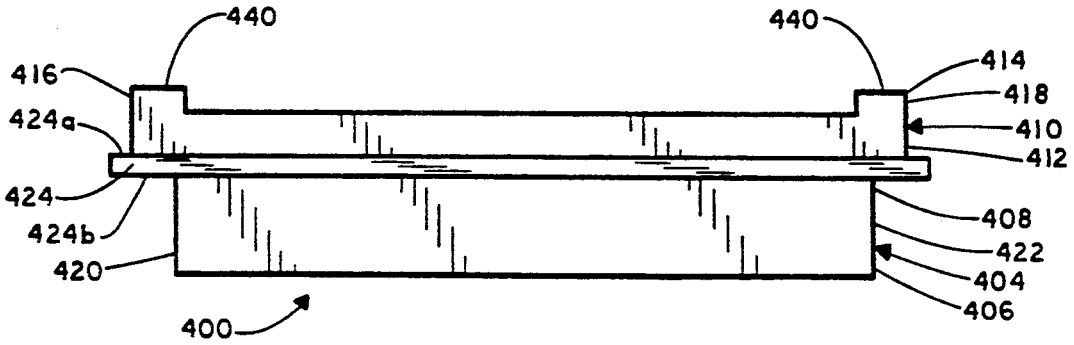
FIG. 19 is a longitudinal elevational view taken along lines 19—19 of FIG. 17.
Figure 19A:
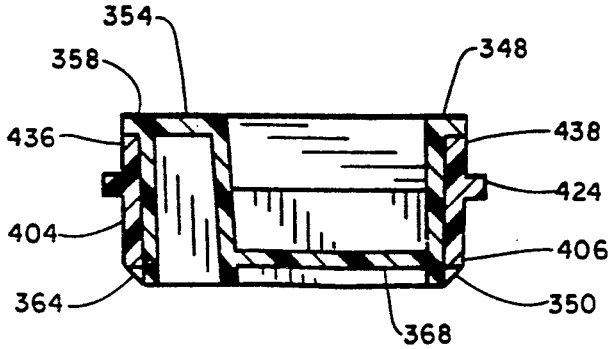
FIG. 19A is a sectional view taken along lines 19A—19A of FIG. 17.

The covers 282 of the grommet 102 are best shown in FIGS. 11, 11A, 11B, 13, 14 and 15 and comprise a pair of side walls 340 and 342 joined by a partial end wall 344. An upper edge 346 of the side wall 340 is formed with an outwardly-extending lip 348. A pair of locking tabs 350 is provided adjacent to a lower edge 352 of the side wall 340. A top wall 354 is formed along an upper edge 356 of the side wall 342 and has an outwardly-extending portion that defines a second lip 358. The side wall 342 includes an offset portion 360, the significance of which is explained more fully below. With reference also to FIG. 19A it can be seen that the side wall 342 includes a double wall section, comprising spaced apart sub-walls 342*a*, 342*b* joined by a return wall 342*c*, and a single wall section, the single wall section being the offset 360 which is contiguous with the double wall sub-wall 342*a*. An exterior surface 362 of the side wall 342 is provided with a pair of locking tabs 364 adjacent to a lower edge 366 thereof.

Figure 16:
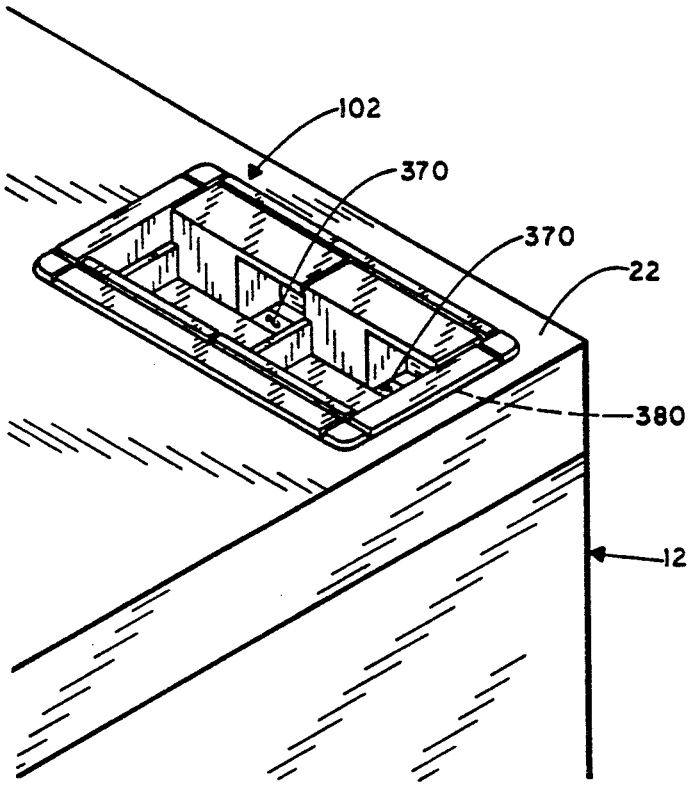
FIG. 16 is a fragmentary perspective view of the grommet of FIGS. 11 to 15 shown in conjunction with an article of furniture and with the removable covers thereof in an alternative arrangement.
Figure 16A:
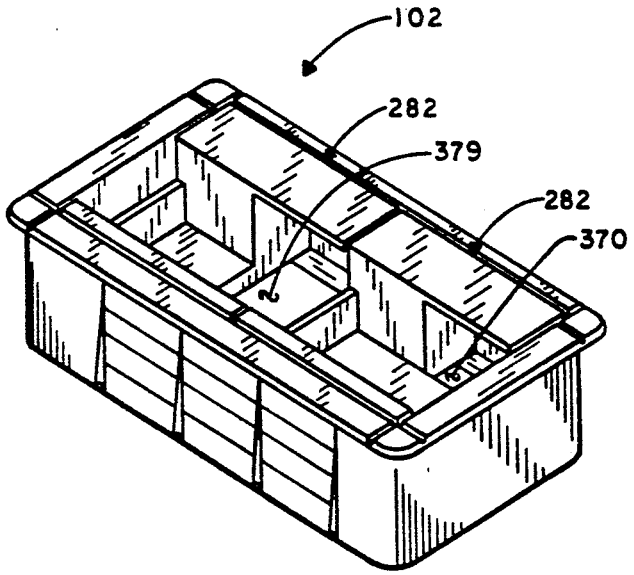
FIG. 16A is a fragmentary perspective view of the grommet of FIG. 16 but with a removable section of one of the covers thereof having been removed.
Figure 16B:
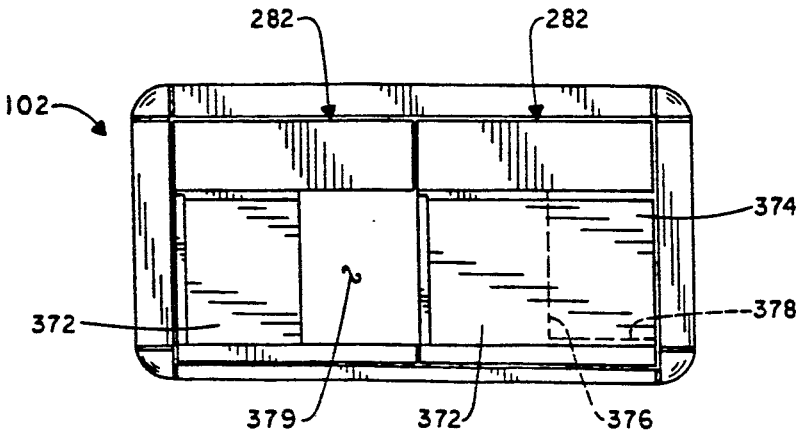
FIG. 16B is a top plan view of the grommet of FIG. 11 but with a removable section of one of the covers thereof having been removed.

A base wall 368 is mounted to and between the side walls 340 and 342 and the end wall 344. However, the base wall 368 does not extend to the offset portion 360 of the side wall 342 thereby creating a wire access opening 370. The base wall 368 includes a fixed section 372 and a removable section 374, there being a frangible connection between the fixed and removable sections as well as between the removable section and the side wall 340, which frangible connections are represented by the broken lines 376 and 378, respectively. As explained hereinbelow and as best shown in FIGS. 16A and 16B, the removable section 374 can be removed by fracturing the frangible connections 376 and 378, thereby creating an even larger wire opening 379. Alternatively, the frangible connections 376 and 378 can be in the form of a groove 377 molded into the cover, the grooves providing a knife guide for cutting the removable section 374 from the cover 202.

In assembly, as best shown in FIGS. 11, 11C, 11D, 11E, 11F and 16, the grommet 102 is installed within an article of furniture such as the desk 12 and is generally associated with planar horizontal surfaces such as work tops, upper surfaces, and the like. For example, the desk 12 is provided with an opening 380 in the desk top 22, which opening is adapted to receive the grommet 102A. The covers 282 of the grommet 102 are received within the sleeve 280 such that the first and second side wall lips 348 and 358 engage and are supported by, respectively, the rims 320 and 322 of, respectively, the cover side walls 286 and 288. Further, the cover locking tab pairs 350 and 364 engage the lips 324 and 326 on the inside surfaces 316 and 318 of the sleeve side walls 286 and 288, thereby releasably retaining the covers 282 within the sleeve 280. Preferably, the covers 282 are removed from the sleeve 280 by engaging the underside of the top wall section 354 (for example, by a user engaging a finger with the top wall section underside) and applying an upwardly directed force sufficient to overcome the engagement of the tab pairs 350, 364 with the sleeve lips 324 and 326. Alternatively, the covers 282 can be removed from the sleeve 280 by applying an upwardly directed force to the cover base wall sufficient to overcome the yielding resistance offered by the engagement of the tab pairs 350 and 364 with, respectively, the sleeve lips 324 and 326.

Once the covers 282 have been installed within the sleeve 280, the grommet 102 can be mounted to an article of furniture such as the desk 12. For example, the grommet 102B is received within the desk top opening 380, such that the ribs 302 and 310, respectively of the exterior surfaces 300 and 308 of the cover side walls 286 and 288 bear against the interior wall of the opening 380. The underside 297 of the flange 296 engages and is supported by the desk top 22. Preferably when the grommets 102 are mounted above the modesty panel of a furniture article, such as the grommet 102A mounted above the modesty panel 28 of the desk 12 or the grommet 102E mounted above the modesty panel 76 of the credenza 20, the grommet is positioned such that it is centered over the vertical plane defined by the modesty panel. Thus, cables routed through the grommet 102 may be passed either into the knee space for the furniture article or to the exterior of the furniture article. Cable access from both sides of the furniture article is possible. If the furniture article also includes grommets 100, it is preferred that all of the grommets 100 and 102 for the furniture article be positioned such that they are aligned.

A particular feature of the cover members 282 should be noted. The top wall 354 is mounted to the offset portion 360 of the cover side wall 342 and overlies and partially defines the wire access opening 370. Thus, when the cover 282 is received within the sleeve 280 and the entire grommet 102 is mounted to a flat work surface or the like, the wire access opening 370, though entirely functional, is largely obscured from view. In this manner, wire access to the knee space or the interior of the pedestal is provided without the knee space, the pedestal interior, or the wire access opening being readily visible. Further, the routing of cables through the wire access opening 370 is substantially hidden from view. This feature contributes to maintaining the neat and professional appearance of the fine wood furniture to which the grommets can be mounted.

Figure 11A:
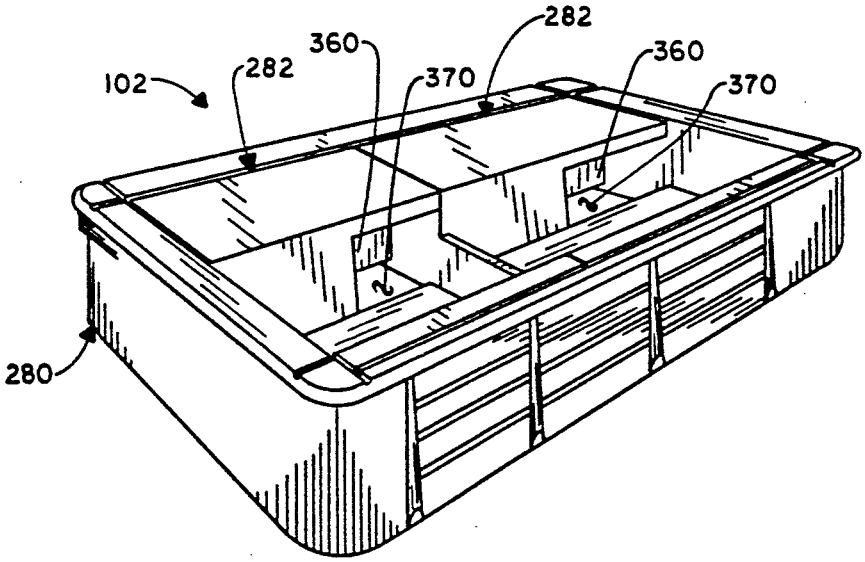
FIG. 11A is a perspective view of the fully assembled grommet of FIG. 11.
Figure 11B:
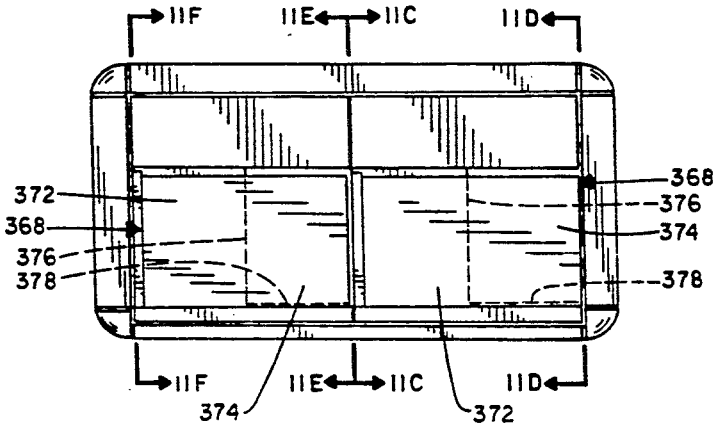
FIG. 11B is a top plan view of the grommet of FIG. 11A.
Figure 11C:
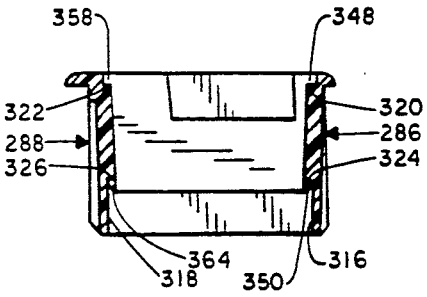
FIG. 11C is a sectional view taken along lines 11C—11C of FIG. 11B.
Figure 11D:
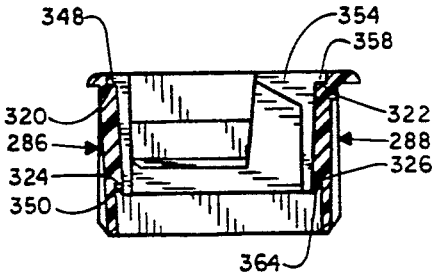
FIG. 11D is a sectional view taken along lines 11D—11D of FIG. 11B.
Figure 11E:
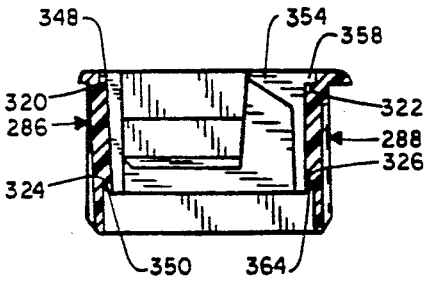
FIG. 11E is a sectional view taken along lines 11E—11E of FIG. 11B.
Figure 11F:
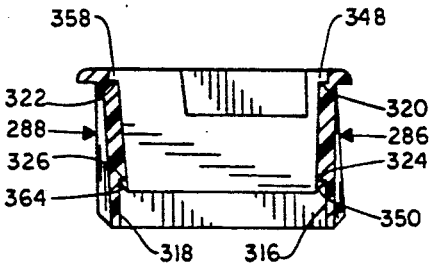
FIG. 11F is a sectional view taken along lines 11F—11F of FIG. 11B.
Figure 16C:
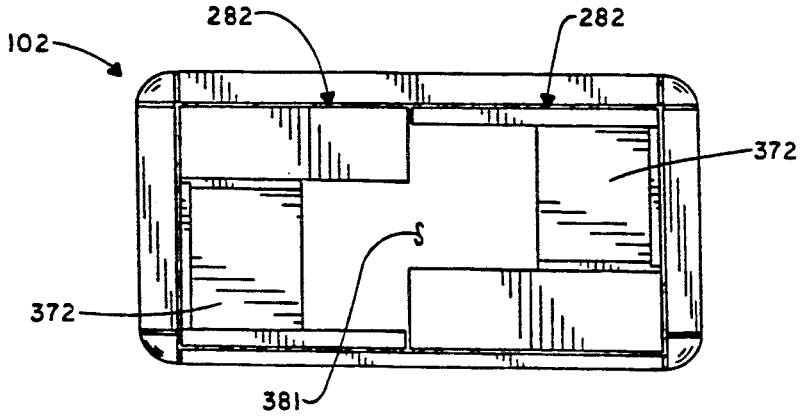
FIG. 16C is a top plan view of the grommet of FIG. 11 but showing an alternative arrangement of the covers therefore.
Figure 17:
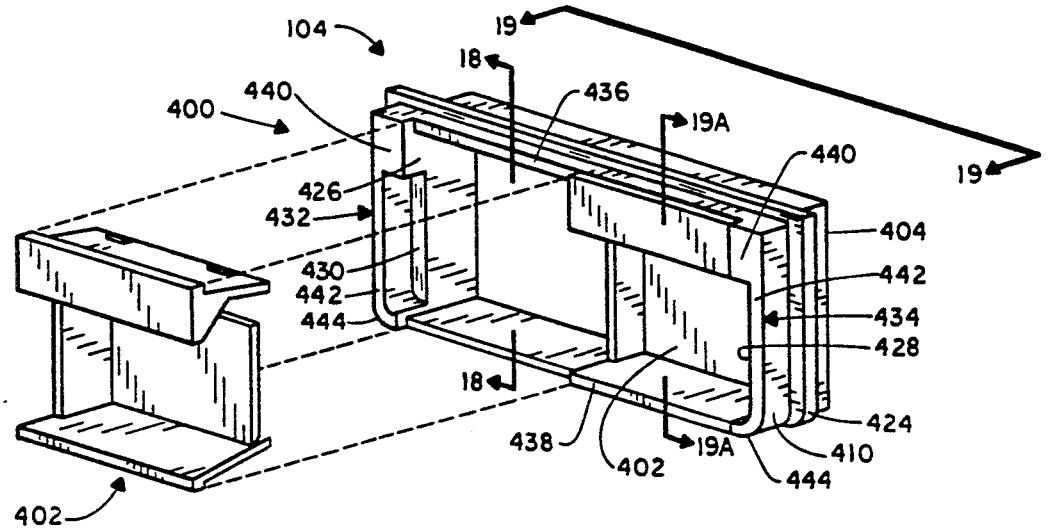
FIG. 17 is an exploded perspective view of a third grommet of the wire management system.
Figure 18:
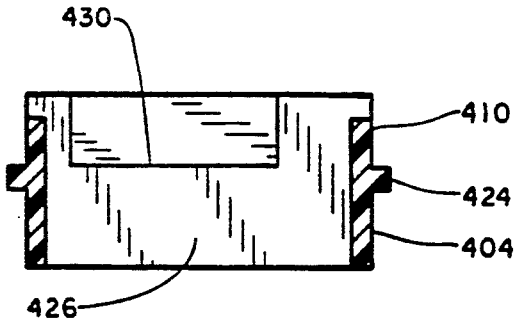
FIG. 18 is a sectional view taken along lines 18—18 of FIG. 17.

The grommet 102 is larger than the grommet 100 and, therefore, it is preferred that the grommet be used principally with secondary work surfaces such as the grommets 102B, 102D, 102C, and 102E that are associated with, respectively, the component tables 14 and 16, the bridge 18, and the credenza 20. However, the grommet 102 is adaptable for use with primary work surfaces such as the grommet 102A mounted to the desk 12. The grommet 102 provides a flexible wire manager because it can be manipulated to provide wire openings of various size. For example, cables routed beneath the desk 12 may be brought to the desk top 12 by passing them through the wire access opening 370 formed in each grommet cover 282. The size of the wire opening 370 may be enlarged to provide the wire opening 379 by removing the removable section of the grommet base wall 368. As noted hereinabove, the removable section 374 is bounded by the frangible connections 376 and 378 which can be fractured by applying sufficient force to the removable section or by cutting. As best shown in FIGS. 16A and 16B, once the removable section 374 has been so removed, the wire opening 379, which is larger than the wire opening 370, is created. The wire opening 379 may be provided in either or both grommet covers 282. If still a larger wire opening is required, either one or both covers 282 can be removed from the sleeve 280. If one cover 282 is removed from the sleeve 280, the cover 282 that remains is slidable within the sleeve 280 between the sleeve end walls 290 and 292. A wire opening 381 of a size intermediate that of the wire opening 379 and the wire opening created by removing one of the covers 282 may be realized, as best shown in FIG. 16C, by inverting one of the covers relative to the other cover and removing the removable sections 374 from each cover. Similarly, and as shown in FIGS. 16 and 16A, both covers 282 may be inverted relative to the orientation shown in FIGS. 11A and 11B, although the arrangement of FIGS. 11A and 11B is preferred for aesthetic reasons.

It is also possible to temporarily enlarge the size of the wire openings 370 and 379 if, for example, a large plug end must be received by the grommet 102. The cover 282 need only be removed from the sleeve 280, the plug passed through the sleeve, and the cover replaced such that the cable is received by either the wire opening 370 or 379 as the case may be. The wire opening size can be adjusted to accommodate cables or bundles of cables of various size, while still allowing for selective enlargement of the opening to receive a plug end.

The grommet 104 is best shown in FIGS. 17 to 20 and comprises a one-piece, injection-molded plastic hollow retainer sleeve 400 and a pair of one-piece injection-molded plastic cover members 402. As noted above, the grommet 104A is substantially identical to the grommets 104B, 104C and so on, the letter designations merely identifying different location for the individual grommets 104 within the wire management system 10.

The sleeve 400 includes a rectangular lower base wall 404 having lower and upper edges 406 and 408, respectively, and a substantially rectangular upper base wall 410. The upper base wall 410 includes an upper edge 414 and a lower edge 412 overlying the upper edge 408 of the lower base wall 404. The dimensions of the lower and upper base walls 404 and 410 in the transverse direction are substantially equal. The longitudinal dimension of the upper base wall 410 is greater than the longitudinal dimension of the lower base wall 404. Thus, end walls 416 and 418 of the upper base wall 410 extend outwardly relative to end walls 420 and 422 of the lower base wall 404. The upper base wall end walls 416, 418 are supported by a continuous, outwardly-extending marginal flange 424 intermediate the lower base wall upper edge 408 and the upper base wall lower edge 412. The flange 424 has upper and lower surfaces **424*a* and 424*b*, respectively. Interior surfaces 426 and 428 of the upper base wall end walls 416 and 418, respectively, are formed with an offset or shelf portion 430. The upper edge 414 of the upper base wall 410 includes a pair of substantially identical end edge portions 432 and 434 and a pair of side edge portions 436 and 438 that are offset from the end edge portions, the significance of which is explained below. The end edge portions 432 and 434 each include a widened area 440 adjacent to the shelf 430 and the side edge portion 436, a narrowed area 442, and a rounded corner 444 adjacent to the side edge portion 438**.

The grommet covers 402 are substantially identical to the grommet covers 282 of the grommet 102 described hereinabove and identical reference numerals designate like or analogous elements. Although the sleeve 400 is shown in conjunction with a pair of covers 402, the sleeve may easily be constructed for use with a single cover or for use with more than two covers.

Figure 20:
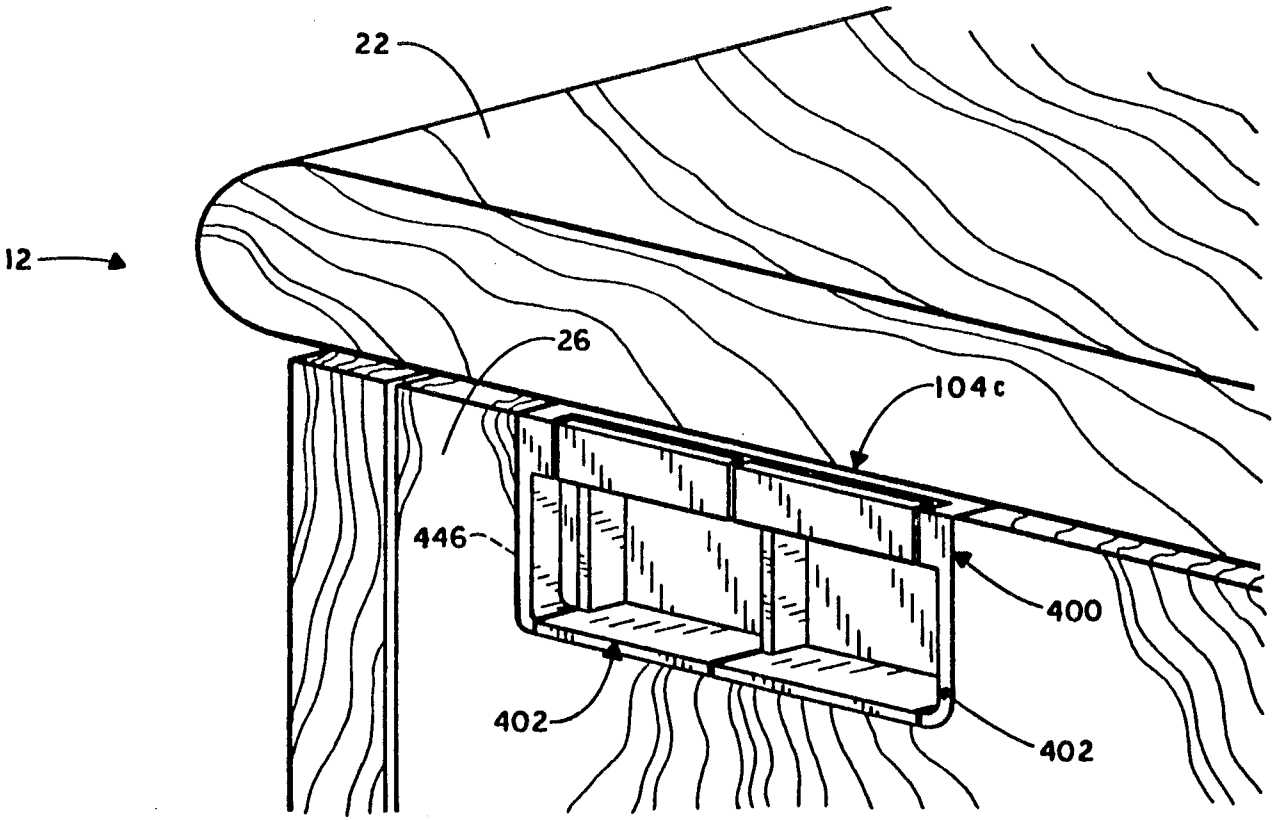
FIG. 20 is a fragmentary perspective view of the grommet of FIGS. 17 to 19A shown in conjunction with an article of furniture.

In assembly, the grommet 104 is installed within an article of furniture such as the desk 12 and is generally associated with vertical planar surfaces such as return panels, inside and outside walls of pedestals, and panel-like support legs. For example, the desk 12 is provided with an opening 446 in return panel 26. The opening 446 has dimensions substantially equal to the dimensions of the retainer sleeve lower base wall 404 and penetrates the entire thickness of the return panel. The covers 402 are inserted within the retainer sleeve 400 such that the cover locking tabs 350 and 364 engage the lower edge 406 of the lower base wall 404, the cover lip 348 is supported by the retainer sleeve side edge 438, and the second cover lip 358 is supported by the retainer sleeve side edge 436. In this arrangement, because the retainer sleeve side edges 436 and 438 are offset relative to the end edge portions 432 and 434, the cover lip 348 is flush with the adjacent rounded corner 444 and the cover top wall 354 is flush with the widened area 440. The cover end wall 344 is also flush with the retainer sleeve shelf 430 thereby imparting a neat and finished appearance to the grommet 104. As best shown in FIG. 20, the position of the flange 424 relative to the upper edge 414 of the upper base wall 410 and the lower edge 406 of the lower base wall 404 is such that when the grommet 104 is mounted to an article of furniture, the retainer sleeve side edges 436, 438, the retainer sleeve end edge portions 432, 434, the rounded corner 444, the widened area 440, the cover lip 348, and the cover top wall 354, which are flush, are also flush with the exterior vertical planar surface of the article of furniture thereby creating a smooth and finished appearance.

The assembled grommet is received within the opening 446 in the article of furniture, such as the grommet 104C mounted to the desk return panel 26. The edge portions of the opening 446 are provided with a dadoo rout (not shown separately in the drawings) which receives the marginal flange 424. Because the covers 402 associated with the grommet 104 are substantially identical to the covers 282 utilized with the grommets 102, the same advantages of a functional but hidden from view wire access opening 370 described hereinabove with regard to the grommet 102 are also realized when the grommets 104 are employed. It will be noted, as shown in FIG. 21A, that the grommet 104B is oriented such that it is more or less bisected by the modesty panel 28. That is, one cover 402 opens into the desk knee space 41 whereas the other cover 402 opens toward the exterior surface of the modesty panel. Thus access to the grommet from both sides of the modesty panel is provided. Further, the grommets 104 are oriented such that they are aligned with the grommets 100 and 102, the significance of which is explained below.

As explained more fully below, by mounting the grommets 104 to vertical planar surfaces, the passage of cables through an article of furniture or from one article of furniture to an adjacent article of furniture is facilitated. For example, cables can be routed internally of the pedestal 24 of the desk 12 by mounting the grommets 104B and 104A to, respectively, the pedestal interior wall 34 and the pedestal exterior wall 560. Alternatively, the cables could be passed through the grommet 104C in the desk return panel 26 and through the grommet 104D in the leg 46 of the component table 14. Because the grommet 104 includes covers 402 that are substantially identical to the covers 282, the cables can be passed through the wire opening 370. The opening 370 can be enlarged to the size of the opening 379 by removing the removable section 374 of the base wall 368. As well, either one or both covers 402 can be removed to further enlarge the wire opening size. If one cover 402 is removed, the remaining cover 402 is slidable with respect to the sleeve 400 between the sleeve end walls. As with the grommet 102, the size of the wire opening can be increased to a size intermediate the size of the wire opening 379 and the size achieved when one of the covers is removed by inverting one of the covers 402 relative to the other cover 402 and removing the removable section 374 of each cover.

3. Pivotally Mounted Modesty Panels

Figure 2:
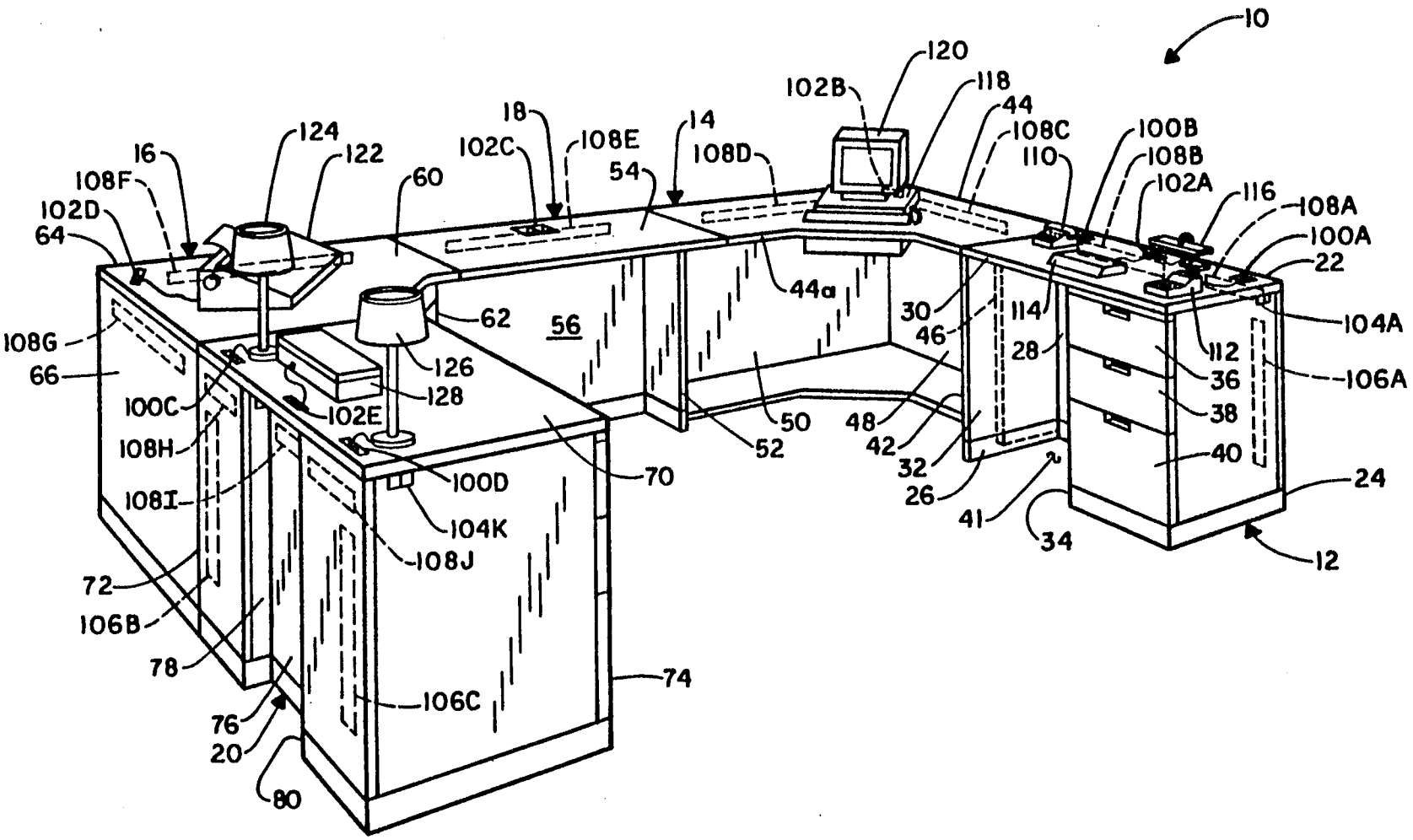
FIG. 2 is a perspective view of the arrangement of FIG. 1 from a different direction.
Figure 3:
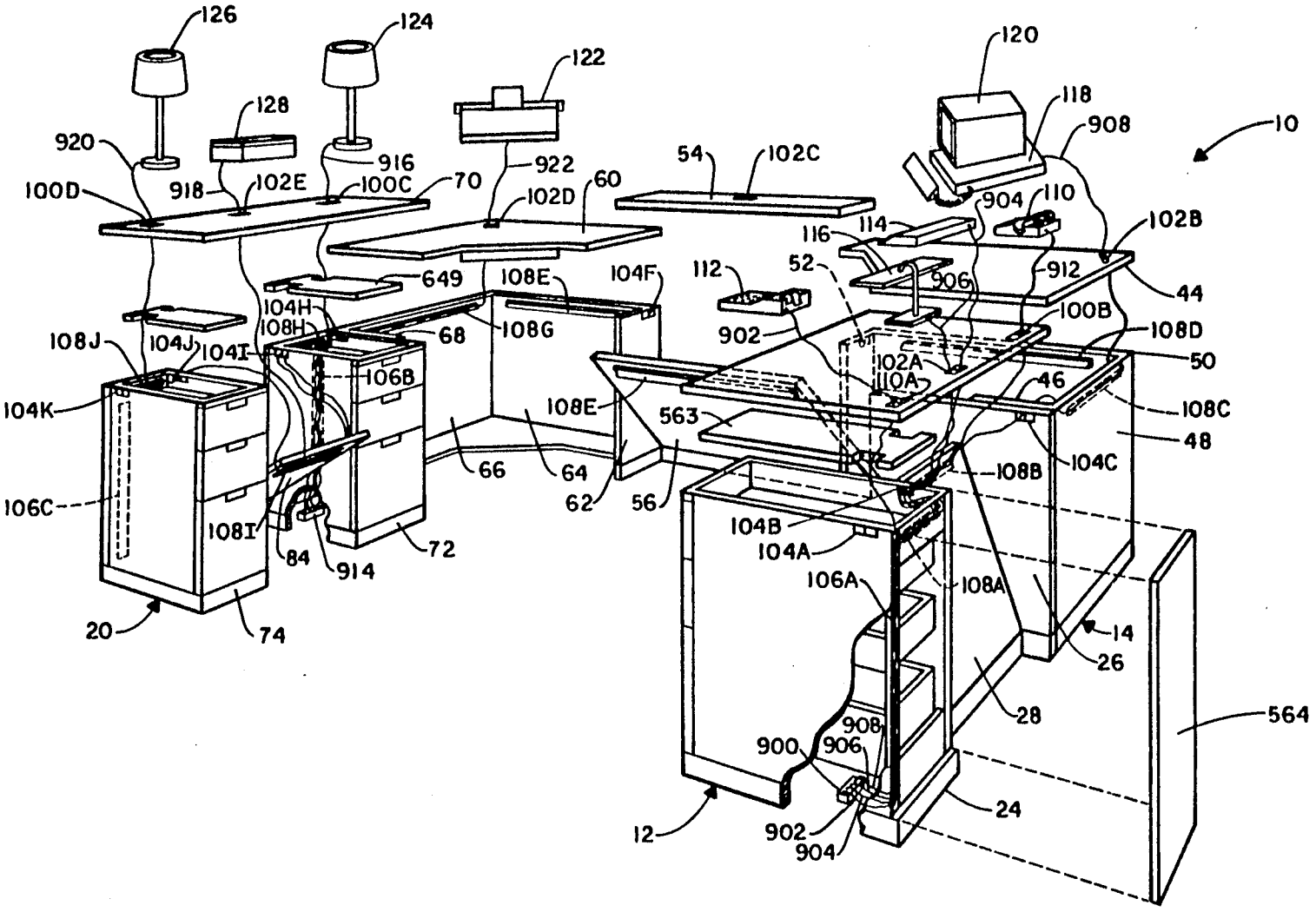
FIG. 3 is an exploded and partially broken-away perspective view of the arrangement of furniture of FIG. 1.
Figure 4:
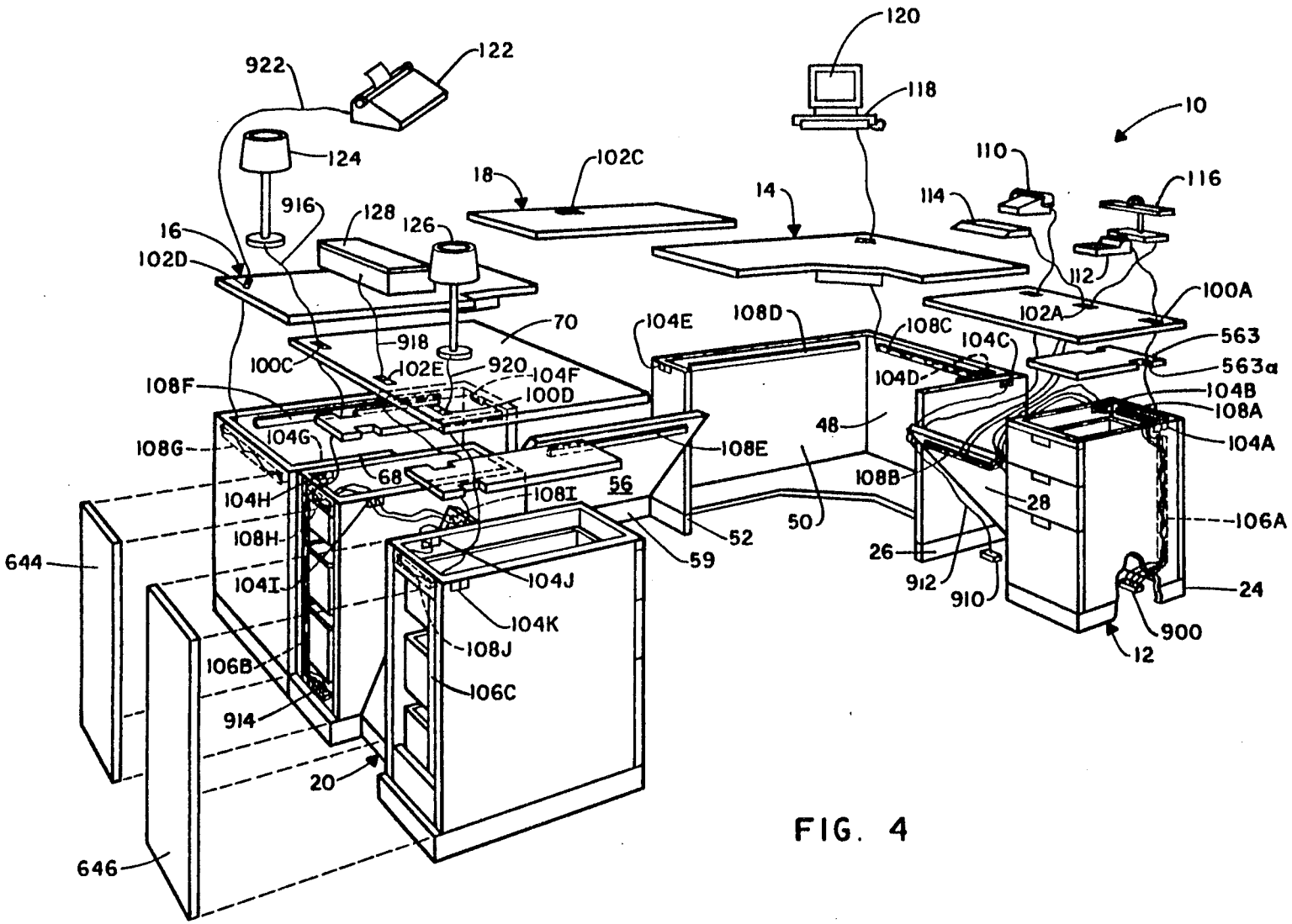
FIG. 4 is an exploded and partially broken-away perspective view of the arrangement of furniture of FIG. 2.

A further aspect of the wire management system 10 is the provision of pivotally mounted modesty panels for several of the articles of furniture. For example, as shown in FIGS. 3 and 4, the desk 12 includes a pivotally mounted modesty panel 28 and the credenza 20 includes a pivotally mounted modesty panel 76. Although only the desk 12 and the credenza 20 are shown as including pivotally mounted modesty panels, it will be understood that a modesty panel associated with any article of furniture can be mounted for pivoting movement in accordance with the invention. A modesty panel functions to enclose the rear wall, that is the wall that faces a guest, of an article of furniture and is typically positioned beneath the underside of the furniture top and spans between opposite side portions of the furniture article. In the case of an article of furniture having a pair of spaced-apart pedestals, the modesty panel extends between the facing inside side walls of the pedestals. In the case of an article of furniture having a single pedestal supporting one end of the furniture top and a return panel supporting the opposite end, the modesty panel extends between an inside wall of the pedestal and an interior surface of the return panel. The bridge 18 of FIGS. 1 to 4 compromises a modesty panel 56 pivotally mounted to the edge 58 of the work surface 54.

Figure 21:
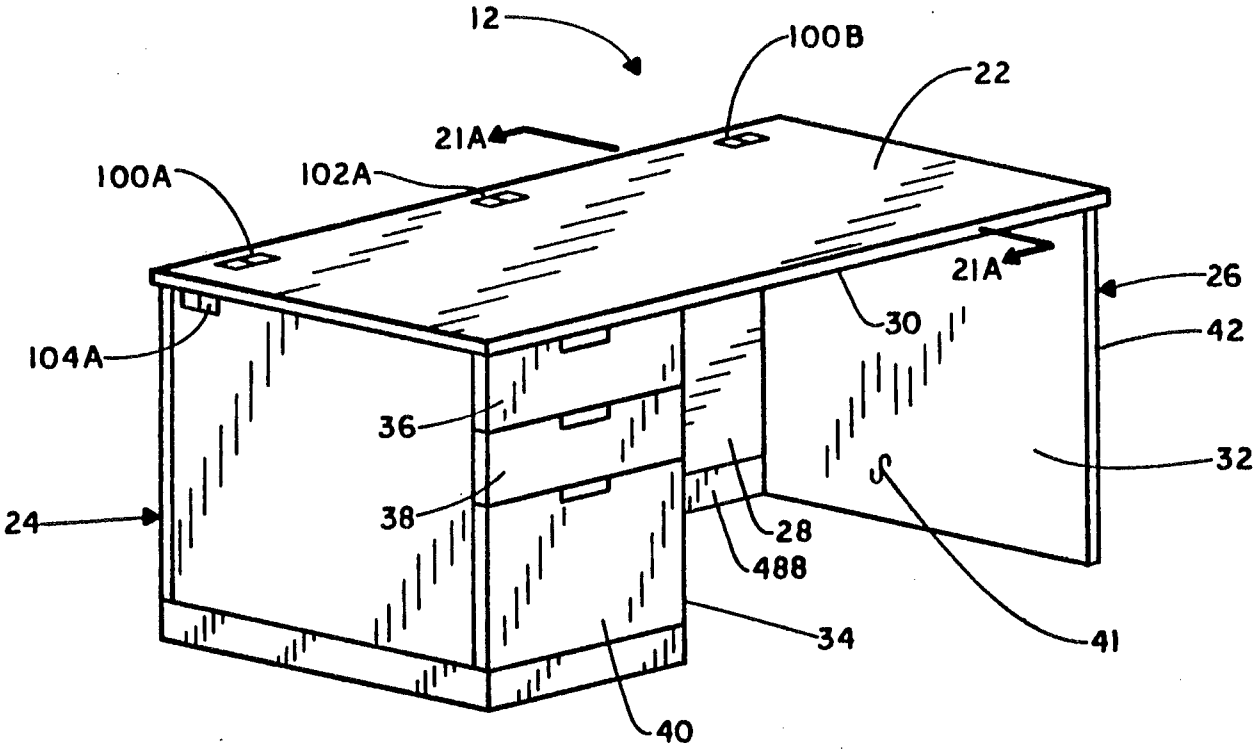
FIG. 21 is an enlarged perspective view of a desk of the furniture arrangement of FIGS. 1 to 4.
Figure 21A:
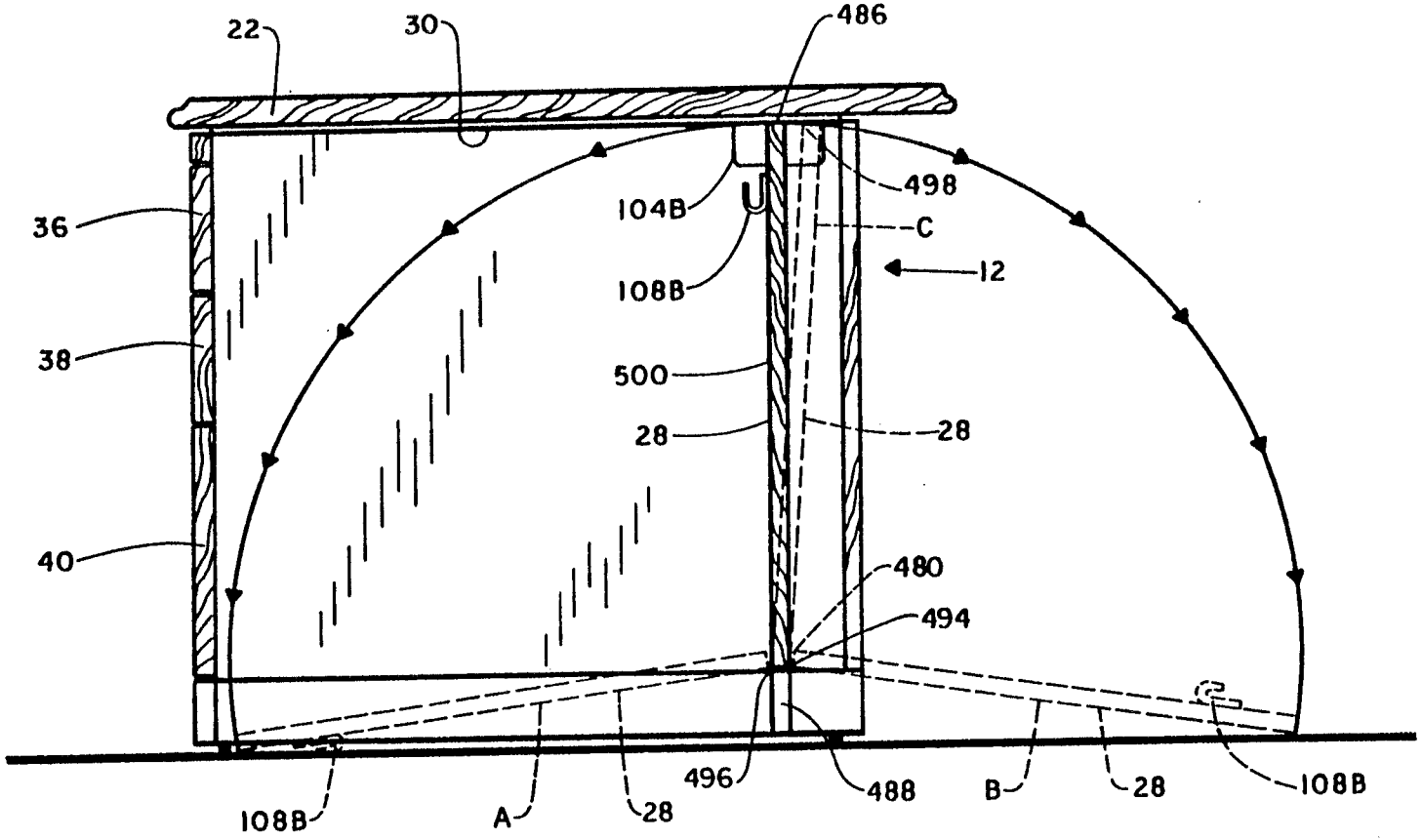
FIG. 21A is a sectional view taken along lines 21A—21A of FIG. 21 and showing alternative positions of a modesty panel thereof in broken lines.
Figure 22:
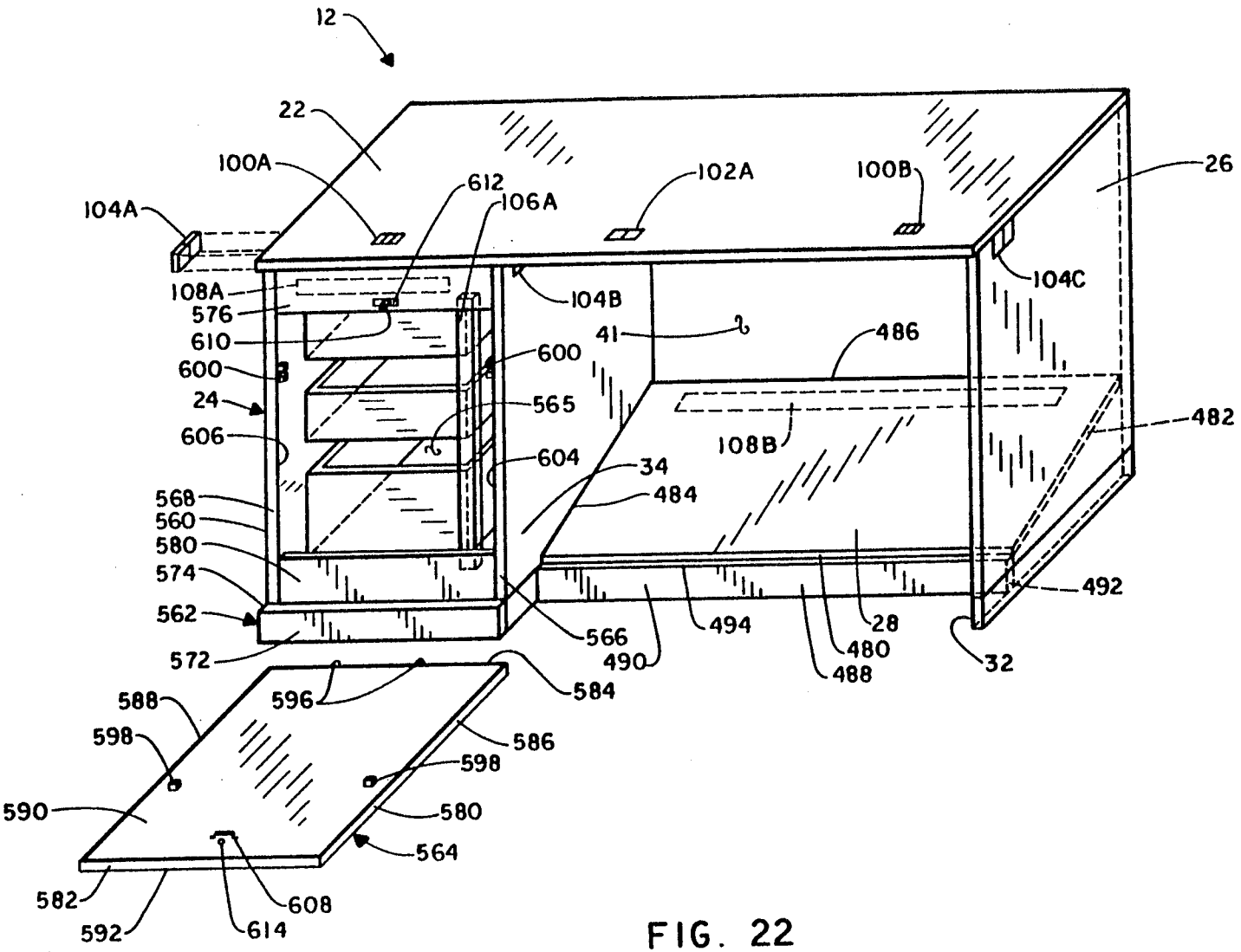
FIG. 22 is an enlarged perspective view of a rear of the desk of FIG. 21 and showing a modesty panel thereof in an open position and a pedestal back thereof having been removed.

Thus, with reference to FIGS. 21, 21A and 22 showing the desk 12 in greater detail, it can be seen that the modesty panel 28 is mounted for pivoting movement between a closed position (FIG. 21; solid line position of FIG. 21A) and an open position (FIG. 22; broken line positions of FIG. 21A) in which the modesty panel is displaced either within the knee space 41 (as shown by the broken line position designated by the reference A) or away from the front of the desk (as shown by the broken line position designated by the reference B). As explained more fully below, the modesty panel 28 can be adapted for movement only to the position A, only to the position B, or for movement to either position.

More particularly, the modesty panel 28 includes a bottom edge 480, a pair of side edges 482 and 484, and a top edge 486. The desk 12 further includes a base rail 488 secured at its opposite ends 490 and 492 to, respectively, the interior wall 34 of the pedestal 24 and the inside surface 32 of the return panel 26. The bottom edge 480 of the modesty panel 28 is hingedly mounted to an upper edge 494 of the base rail 488 by a continuous hinge 496 or other appropriate articulating joint such that the modesty panel is, in one embodiment, adapted to swing into the knee space 41. A spring stop or catch 498 is mounted to the underside 30 of the desk top 22 to retain the modesty panel 28 in the closed position. The wire management channel 108B is mounted to an interior surface 500 of the modesty panel 28 and, as explained below, has a generally J-shaped configuration and can function as a pull grip for the modesty panel 28.

Figure 21B:
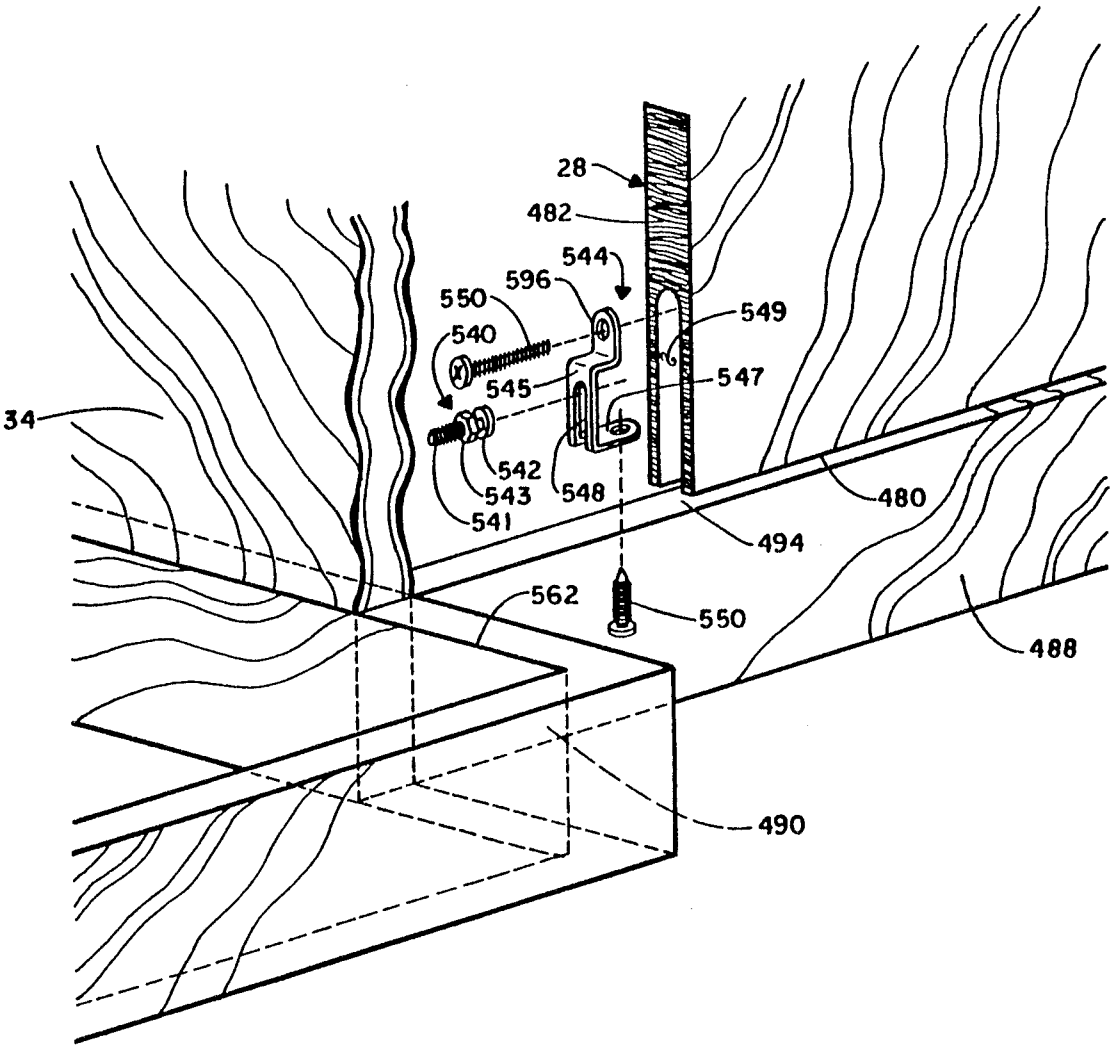
FIG. 21B is an exploded fragmentary perspective view of an alternative means for mounting the modesty panel of FIG. 21.
Figure 21C:
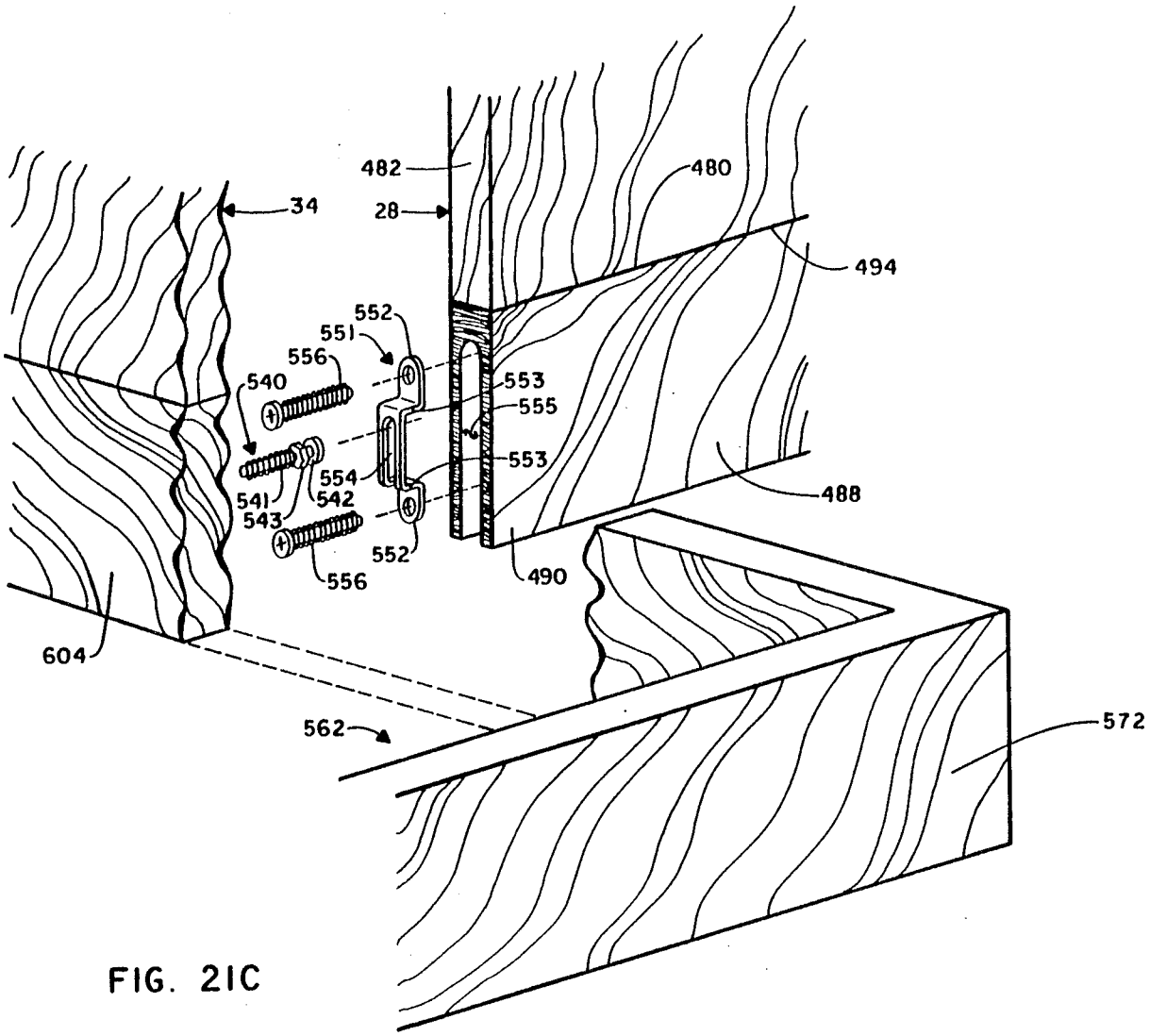
FIG. 21C is an exploded fragmentary perspective view of a third means for mounting the modesty panel of FIG. 21.
Figure 21D:
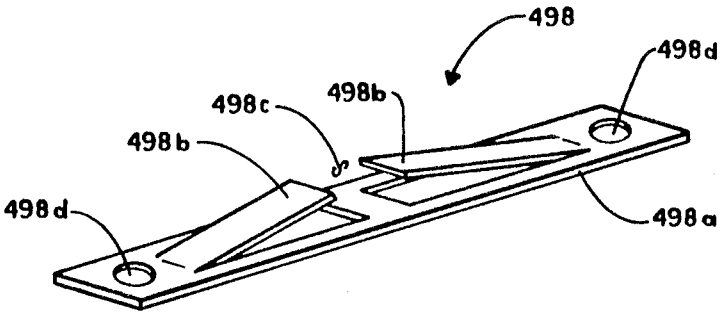
FIG. 21D is a perspective view of a catch for the pivotally mounted modesty panel.
Figure 21E:
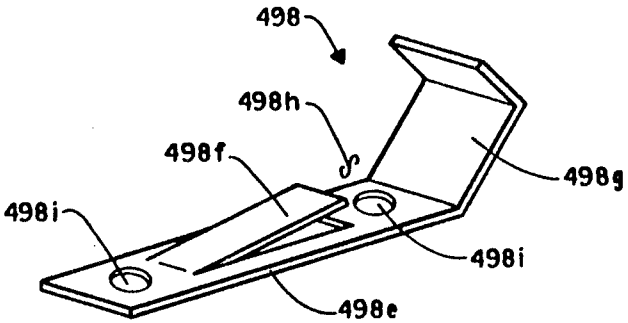
FIG. 21E is a perspective view of an alternative embodiment of the catch for the pivotally mounted modesty panel.

Suitable examples of the spring stop 498 are illustrated in FIGS. 21D and 21E. The spring stop 498 of FIG. 21D comprises a flat mounting base 498*a* having a pair of spaced apart, struck out leaves 498*b* that define therebetween a channel 498*c*. A pair of mounting apertures 498*d* can be used to secure the stop 498 to the desk 12 with conventional threaded mechanical fasteners (not shown separately in the drawings). The stop 498 of FIG. 21E includes a flat base 498*e* having a single struck out leaf 498*f* that cooperates with an L-shaped leg 498*g* integral with the base to define a channel 498*h* therebetween. A pair of mounting apertures 498*i* may be used to secure the stop 498 to the desk 12 with conventional threaded mechanical fasteners (not shown separately in the drawings). The modesty panel 28 is received in the channel 498*h* to be retained in the closed position.

In operation, a user grasps the channel 108B and pulls in a direction toward the front of the desk to move the modesty panel 28 into the knee space 41 (alternatively, if the modesty panel 28 is to be moved to the broken line position of FIG. 21A designated by the reference B, the user applies a force in the opposite direction). If the spring stop 498 of the type shown in FIG. 21D is employed, the user must depress one of the leaves 498*b* a distance sufficient to allow the modesty panel 28 to clear the same, the leaf which is depressed depending of course on the direction the modesty is to be pivoted. Thus the modesty panel is released from the spring stop for pivoting movement from the closed position of FIG. 21 to one of the open positions of FIG. 21A. If a spring stop 498 of the type shown in FIG. 21E is employed, the leaf 498*f* must be depressed to release the modesty panel 28. The spring stop of FIG. 21E is useful only if the modesty panel is adapted for pivoting movement in a single direction. To move the modesty panel 28 to the closed position, the above-described operations are reversed.

As noted above and as best seen in FIG. 21A, the modesty panel 28 when in the closed position more or less bisects the wire management grommets 104. In general, the modesty panels of the various articles of furniture are positioned such that they bisect the adjacent grommets 104 whether they be mounted to an inside wall of a pedestal or a return panel. Thus, the grommets 104 are accessible from both within the knee space and from the exterior of the desk. To facilitate access to that grommet cover which opens into the knee space, the modesty panel is mounted with sufficient flexibility such that it can be displaced slightly in a direction away from the knee space as shown by the alternative position of the modesty panel in FIG. 21A designated by the reference C.

As explained more fully below, because the desk 12 includes the pivoting modesty panel 28, the desk may be placed with the rear or guest side thereof facing and closely adjacent to a wall. Electrical and communications receptacles carried by the wall are easily accessed for supplying power and communications utilities to the various items associated with the desk 12 such as the telephone 110 and the calculator 112 even though direct access to the receptacles may not be possible. By pivoting the modesty panel 28 to the open position wherein the modesty panel is disposed within the knee space 41, the receptacles are accessible without need for moving the desk. Thus the desk can be positioned where it is convenient to place it from a dimensional consideration without being concerned whether the various receptacles remain unencumbered by the desk.

In an alternative embodiment, the hinge 496 can be replaced with a hinge of the double operating continuous type that permits the modesty panel 28 to fully swing both into the knee space 41 and in a direction toward the rear or guest side of the desk 12 (as shown by the broken line positions of FIG. 21A designated by the references A and B). The spring stop 498 of the type shown in FIG. 21D is particularly useful in this arrangement as either leaf 498*b* can be depressed to allow the modesty panel 28 to swing in the desired direction. On the other hand, if the modesty panel 28 is adapted to swing in only a single direction (preferably into the knee space), then the spring stop 498 shown in FIG. 21E as noted above, can be employed.

In a third embodiment, as best shown in FIG. 21B, the modesty panel 28 can be adapted to fully swing both into the knee space 41 and toward the rear of the desk 12 as well as being removable. A shoulder screw 540 or the like, is, in the case of the desk 12, mounted to both the inside wall 34 of the pedestal 24 and the inside surface 32 of the return panel 26 (although only the inside wall of the pedestal is shown in FIG. 21B). The screw 540 generally includes a partially threaded shaft 541 having formed at one end thereof a head 542 and a circumferential flange 543 longitudinally spaced away from the head. A slotted clip 544 is secured to each side edge 482 and 484 of the modesty panel 28 (although only the edge 482 is shown in the FIG. 21B), that portion of the shaft 541 between the head 542 and the flange 543 being received within the slotted portion of the clip 544. The clip 544 generally comprises a central member 545 having a mounting ear 546 and a mounting leg 547 extending from opposite ends of the central member. A slot 558 is formed in the central member 545, the longitudinal axis of the slot being aligned with the longitudinal axis of the modesty panel side edge. Preferably the modesty panel side edge is provided with a groove 549 that receives the clip 545. The clip 545 is secured to the panel with threaded mechanical fasteners 550.

In a fourth embodiment as shown in FIG. 21C, the modesty panel 28 can be fixedly secured to the base rail 488 and mounted to the pedestal interior wall 34 and the return panel 26 in the manner described above utilizing the shoulder screw 540 and a clip 551 of a different structure. The modesty panel and base rail in this embodiment are fully swingable in both directions and removable as an integral unit. The slotted clip 551 comprises a U-shaped member having a mounting ear 552 extending from the distal end of each U-leg 553 and a slot 554 formed in the web of the U-shaped member, the longitudinal axis of the slot being aligned with the longitudinal axis of the panel side edge. Preferably, the panel side edge is provided with a groove 555 that receives the clip 551. The clip 551 is secured to the panel with threaded mechanical fasteners 556. The embodiment shown in FIG. 21B is preferred over the embodiment shown in FIG. 21C because in the former arrangement, the base rail 488 is independent of the modesty panel 28 and does not move with the panel. Greater stability is provided to the furniture article if the base rail is fixed and immovable relative to the pedestals and/or return panel.

Figure 23:
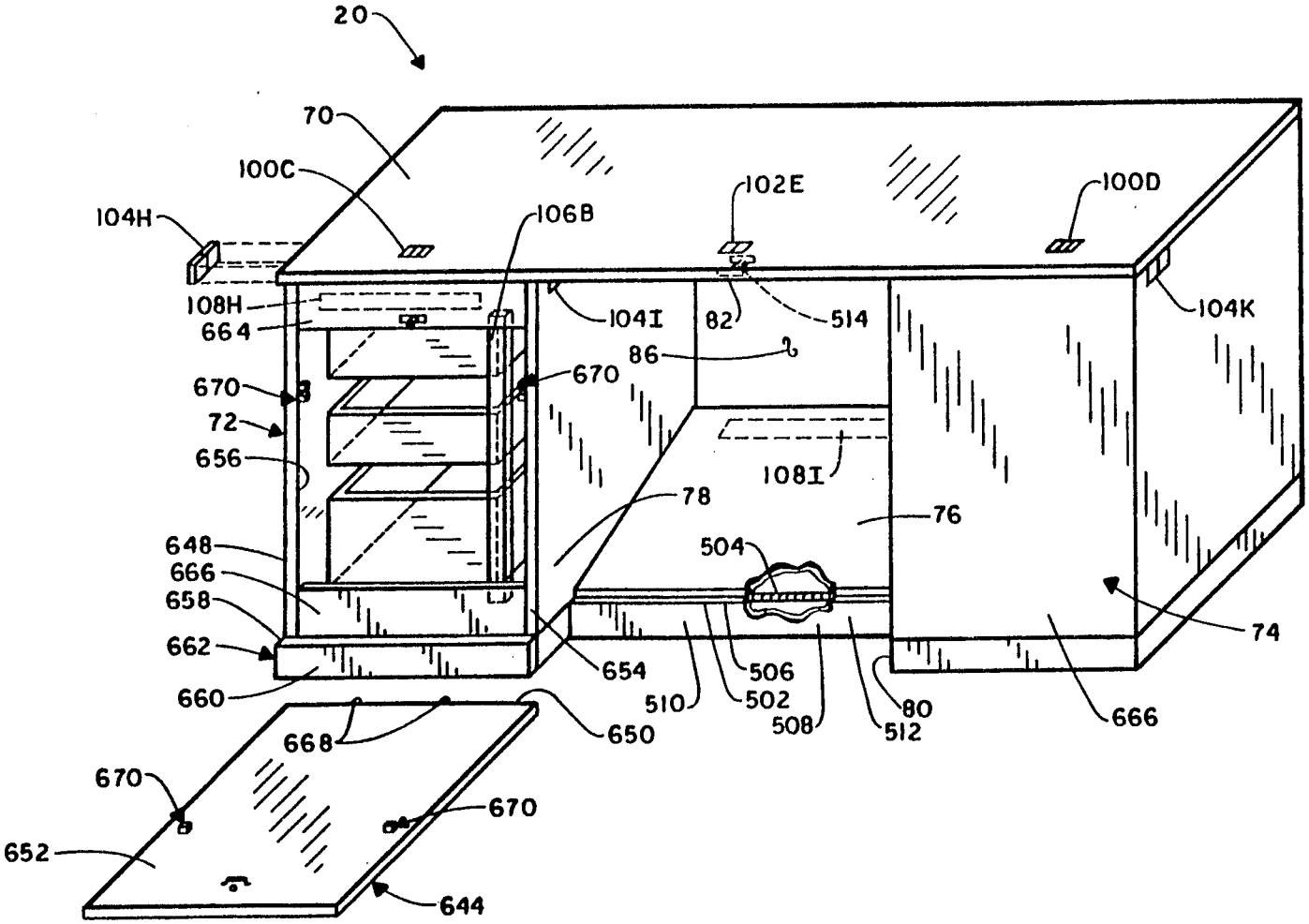
FIG. 23 is an enlarged rear perspective view of a credenza of the furniture arrangement of FIGS. 1 to 4 and showing a modesty panel thereof in an open position and a pedestal back thereof having been removed.

With reference to FIG. 23, there is shown the credenza 20 with the modesty panel 76 thereof in an open position. The modesty panel 76 is similar to the modesty panel 28 and includes a bottom edge 502 pivotally mounted by a hinge or other articulating joint 504 to an upper edge 506 of a base rail 508, opposite ends 510 and 512 of which are secured to, respectively, inside walls 78 and 80 of the pedestals 72 and 74. A spring stop 514 mounted to the underside 82 of the credenza upper surface 70 selectively retains the modesty panel 76 in a closed position. The modesty panel 76 is adapted to swing into the credenza knee space 86 and, to a limited extent, in a direction away from the knee space. As noted with regard to the desk 12, the modesty panel 76 can be adapted to swing fully in both directions, to be removable or to be fixedly secured to the base rail 508 such that they pivot as an integral unit.

Figure 24:
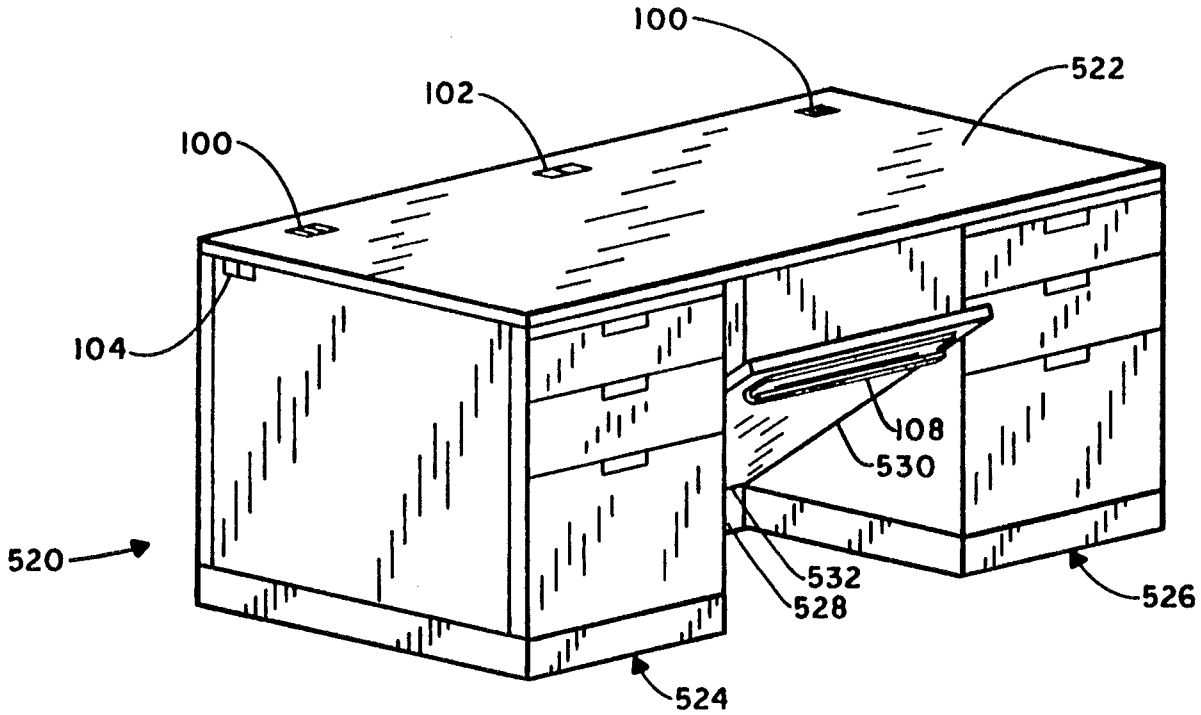
FIG. 24 is a front perspective view of a double pedestal desk incorporating a pivotally mounted modesty panel.

FIG. 24 illustrates a double-pedestal desk 520 comprising a work surface 522, pedestals 524 and 526, a base rail 528, and a modesty panel 530 similar to the desk and credenza modesty panels 28 and 76, respectively, and pivotally mounted to the base rail by a hinge 532 in the several manners described above with regard to the aforementioned modesty panels.

4. Removably Mounted Pedestal Backs

Yet another feature of the wire management system 10 is the provision of removably mounted pedestal backs which facilitate access to the interior of the pedestal for the arrangement and distribution of wiring, as explained more fully hereinbelow. Pedestals generally refer to substantial boxlike structures that support an end of an article of furniture. For example, with reference to FIGS. 1, 2 and 21, the desk 12 includes the single pedestal 24 that supports an end of the desk top 22. As shown in FIGS. 1,2 and 23, the credenza 20 has its upper surface 70 supported at opposite ends by the pedestals 72 and 74. With reference to FIG. 24, the desk 520 includes the work surface 522 that is supported by the pair of pedestals 524 and 526, such a desk being commonly referred to as a double-pedestal desk as opposed to the single-pedestal desk of FIGS. 1, 2 and 21.

The pedestal is a generally boxlike structure that also supports and slidably receives one or more drawers such as the drawers 36, 38 and 40 of the desk 12. In some constructions, as explained more fully below, it may be required to provide drawers to only a single side of the desk yet be desired to maintain the appearance, from the rear or guest side of the desk, of a double-pedestal desk. In such constructions, a false pedestal can be incorporated into the furniture design.

Turning now to FIGS. 3, 4, 21 and 22, the desk 12 includes the pedestal 24 which comprises the interior wall 34 as well as an exterior wall 560, an open rectangular base 562, a back wall 564, and a top wall 563 having notches 563*a* formed therein. The base 562 supports the interior wall 34, the exterior wall 560, and the backwall 564 and is generally open to the floor below, the significance of which is explained below. The front of the pedestal 24 is enclosed by the drawers 36, 38 and 40 which slidably reciprocate into and out of the pedestal on drawer glides or roller mechanisms (not shown separately in the drawings), there being a cavity 565 between rear edges of the drawers and the pedestal back wall 564.

The interior wall 34 and the exterior wall 560 include, respectively, rear edges 566 and 568 and the base 562 includes a rear base rail 572 extending between, respectively, the interior and exterior walls 34 and 560 of the pedestal 24. The rail 572 has an upper edge 574. A pair of upper and lower stretchers 576 and 580 are respectively mounted to and extend between upper and lower portions of the pedestal walls 34 and 560. The back wall or pedestal back 564 is removably mounted to the pedestal 24, thereby facilitating access to the interior of the pedestal 24. The pedestal back 564 includes an upper edge 582, a lower edge 584, and a pair of opposed side edges 586 and 588 as well inside and outside faces 590 and 592, respectively.

Figure 22A:
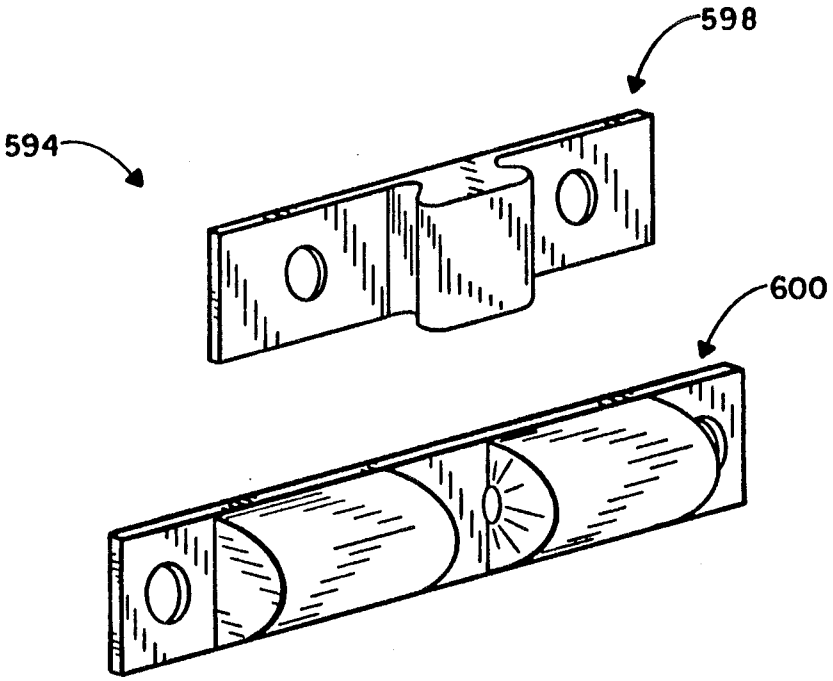
FIG. 22A is a perspective view of a catch for a removably mounted pedestal back.

The pedestal back 564 is mounted to the pedestal 24 of the desk 12 with a pair of catches 594 (FIG. 22A) and a pair of pins 596. Each catch comprises a male locking member 598 and a female retaining member 600. Each male locking member 598 is in the form of a rounded locking lug, one locking member being mounted adjacent each pedestal back side edge 586 and 588. The female retaining member 600 is in the form of a double ball catch. One female retaining member 600 is mounted to an inside surface 604 of the interior wall 34 adjacent the rear edge 566 thereof; the other female retaining member 600 is mounted to an inside surface 606 of the exterior wall 560 and adjacent the rear edge 568 thereof. The female retaining member 600 is positioned and adapted to receive, engage and retain the rounded lug of the male locking member 598 between the ball members of the ball catch to positively secure the pedestal back 564 to pedestal 24. Each pin 596 is received within a bore (not shown separately in the drawings) in the lower edge 584 of the pedestal back 564, the pins extending slightly below the lower edge and received within openings (not shown separately in the drawings) formed in the upper edge 574 of the base rail 572. A handle 608 can also be secured to the inside face 590 of the pedestal back 564.

In assembly, the pedestal back 564 is mounted to the desk 12 such that the pedestal back inside face 590 engages the pedestal rear edges 566 and 568, and further such that the pedestal back lower edge 584 engages or is closely adjacent to the rear base rail upper edge 574. The male locking member 598 and the female retaining member 600 of the catches 594 are engaged and the pins 596 register with the openings in the base rail 572 to securely retain the pedestal back 564 on the desk 12. The outside face 592 of the pedestal back 564 is smooth, finished and imparts a neat appearance to the desk 12. To remove the pedestal back 564, an outwardly directed force is applied to the inside face 590 of the pedestal back until the male locking members 598 are disengaged from the female retaining members 600. It may be necessary to first remove the drawers 36, 38 and 40 in order to facilitate access to the pedestal back 564. To resecure the pedestal back 564, the assembly procedure described hereinabove is followed, the handle 608 being used to assist the process. Alternatively, the pedestal back 564 can be removed from the exterior of the desk by grasping the pedestal back side edges 586, 588 and pulling outwardly with a force sufficient to disengage the male locking members 598 from the female retaining members 600. In this manner, the drawers 36, 38, 40 need not be removed from the pedestal 24.

The pedestal 24 can include a mechanism for locking the drawers 36, 38 and 40 into the pedestal thereby preventing unauthorized access to the pedestal interior and the contents stored therein. Consequently, the pedestal back wall 564 includes means for positively locking or securing the back wall to the pedestal 24. The positive locking means includes a bolt 610 or other threaded mechanical fastener that registers with an aperture 612 formed in the upper stretcher 576 and a threaded insert 614 mounted to the inside face 590 of the pedestal back wall 564.

Figure 24A:
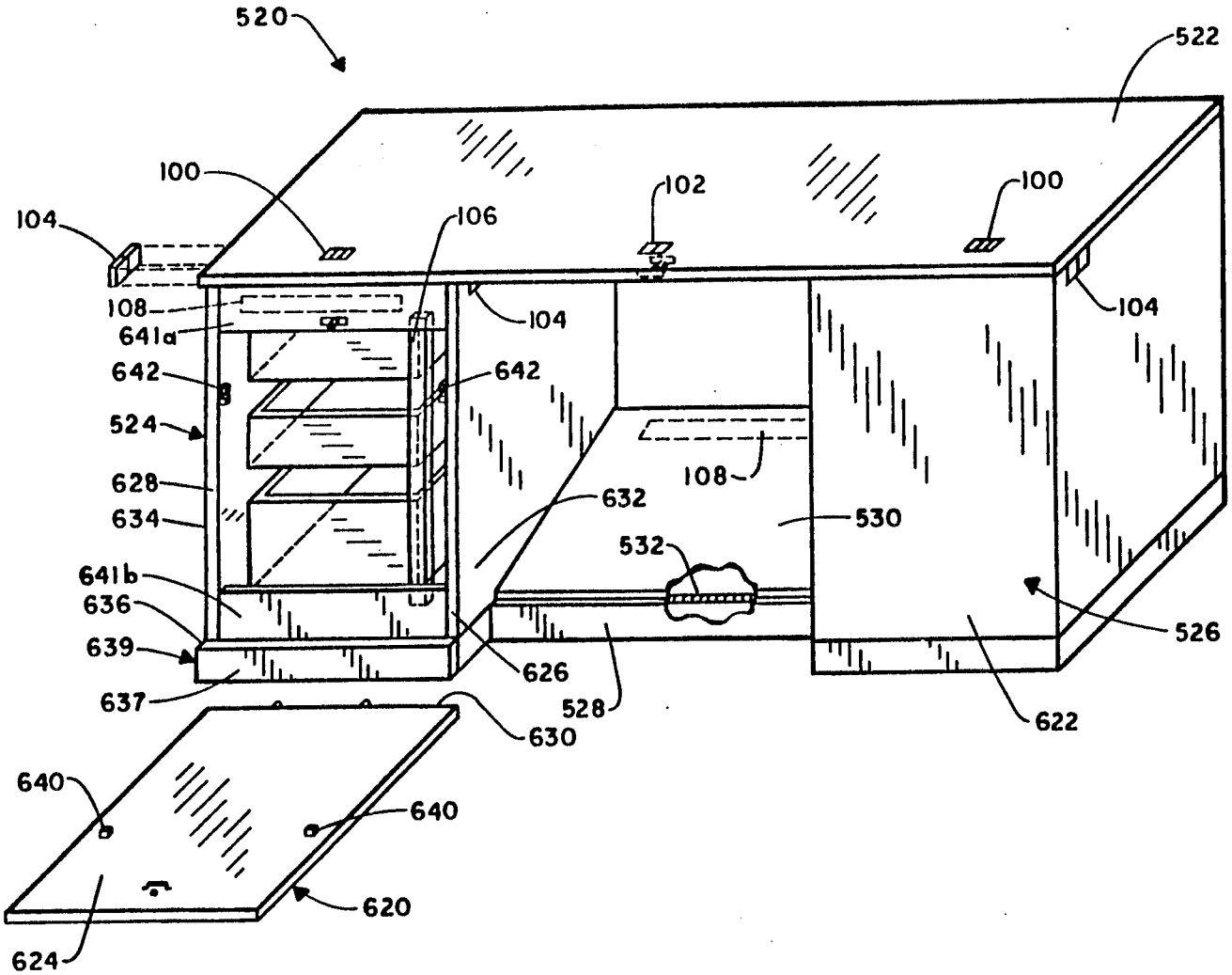
FIG. 24A is a rear perspective view of the double pedestal desk of FIG. 24 and showing a pedestal back thereof having been removed.

Turning now to FIGS. 24 and 24A, it can be seen that the double pedestal desk 520 includes the pair of pedestals 524 and 526. The pedestals 524 and 526 are analogous to the pedestal 24 of the desk 12 and include, respectively, removable back walls 620 and 622. The construction and arrangement of the pedestal back 622 is substantially identical to the pedestal back 620 and thus only the pedestal back 620 will be described with particularity. The pedestal back 620 has an inside surface 624 that engages rear edges 626 and 628, respectively of the pedestal interior wall 632 and the pedestal exterior wall 634. The pedestal 24 also includes a notched top wall (not shown separately in the drawings). A lower edge 630 of the back wall 620 is closely adjacent to an upper edge 636 of a rear base rail 637 of an open base 639. Upper and lower stretchers 641*a* and 641*b* extend between and are secured to the pedestal walls 632 and 634. Further, catches each include a male locking member 640 and a female retaining member 642 that engage to selectively retain the pedestal back 620 on the pedestal 524. The pedestal back wall 620 can be positively locked to the pedestal in the manner described above with regard to the desk 520 (although the mechanism is not shown separately in the drawings) and can be removed therefrom in a similar manner.

Similarly, as shown in FIG. 23, the credenza 20 includes the pair of pedestals 72 and 74. Removably mounted to each pedestal 72 and 74 is, respectively, a pedestal back 644 and 646. The construction and arrangement of the pedestal backs 644 and 646 are substantially identical and will be described with particularity only with reference to the pedestal back 644. The pedestal 72 includes the inside wall 78 as well as an outside wall 648 and a notched top wall 649 (FIG. 3). An inside face 652 of the pedestal back 644 engages rear edges 654 and 656 respectively of the inside wall 78 and the outside wall 648. A lower edge 650 of the pedestal back 644 is closely adjacent to an upper edge 658 of a rear base rail 660 of an open rectangular base 662. Upper and lower stretchers 664 and 666 extend between and are secured to pedestal walls 78 and 648. Pins 668 as well as catches 670 cooperate as described hereinabove with regard to the desks 12 and 520 to selectively and removably mount the pedestal back 644 to the pedestal 72. The pedestal back 644 can be positively locked to the pedestal as described hereinabove for the desk 12 and the credenza 20 (although the mechanism is not shown specifically in the drawings).

Figure 25:
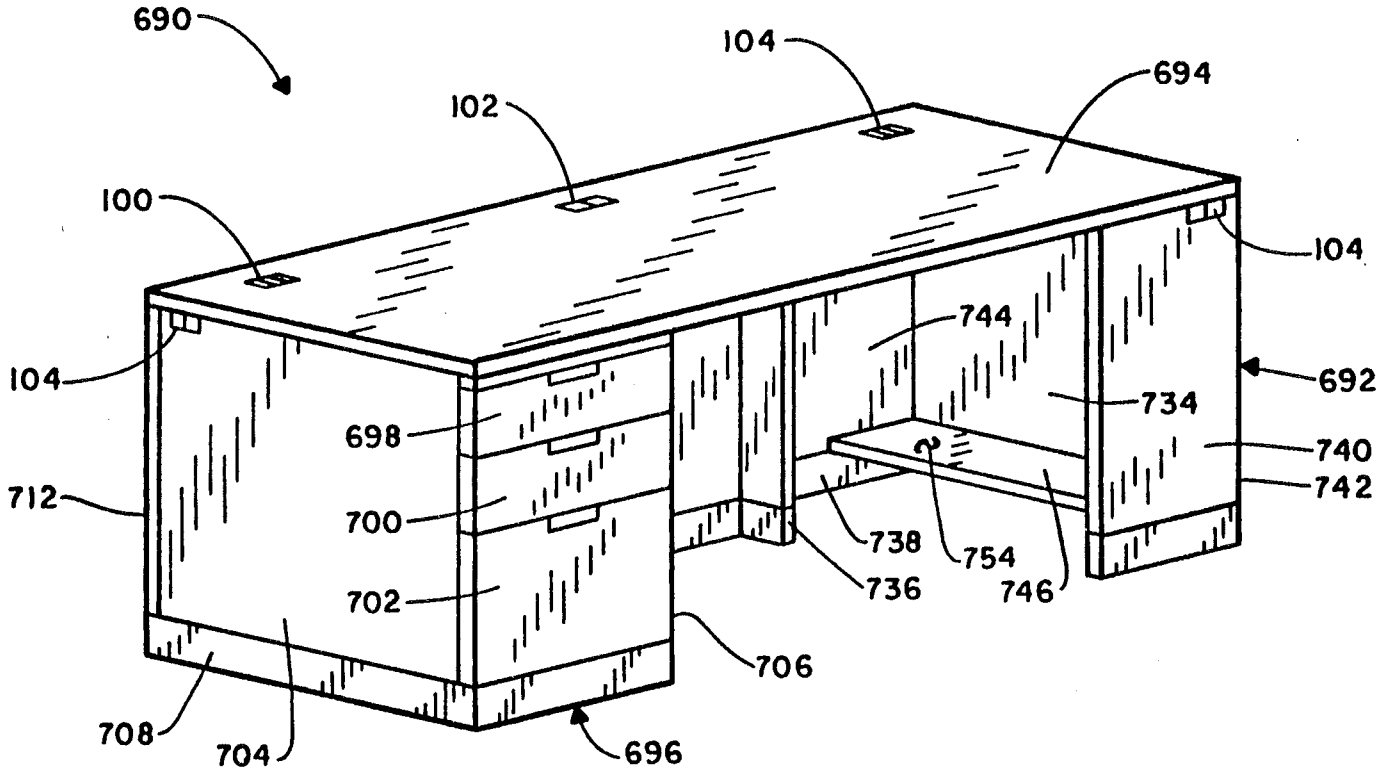
FIG. 25 is a front perspective view of a desk having a false pedestal.
Figure 26:
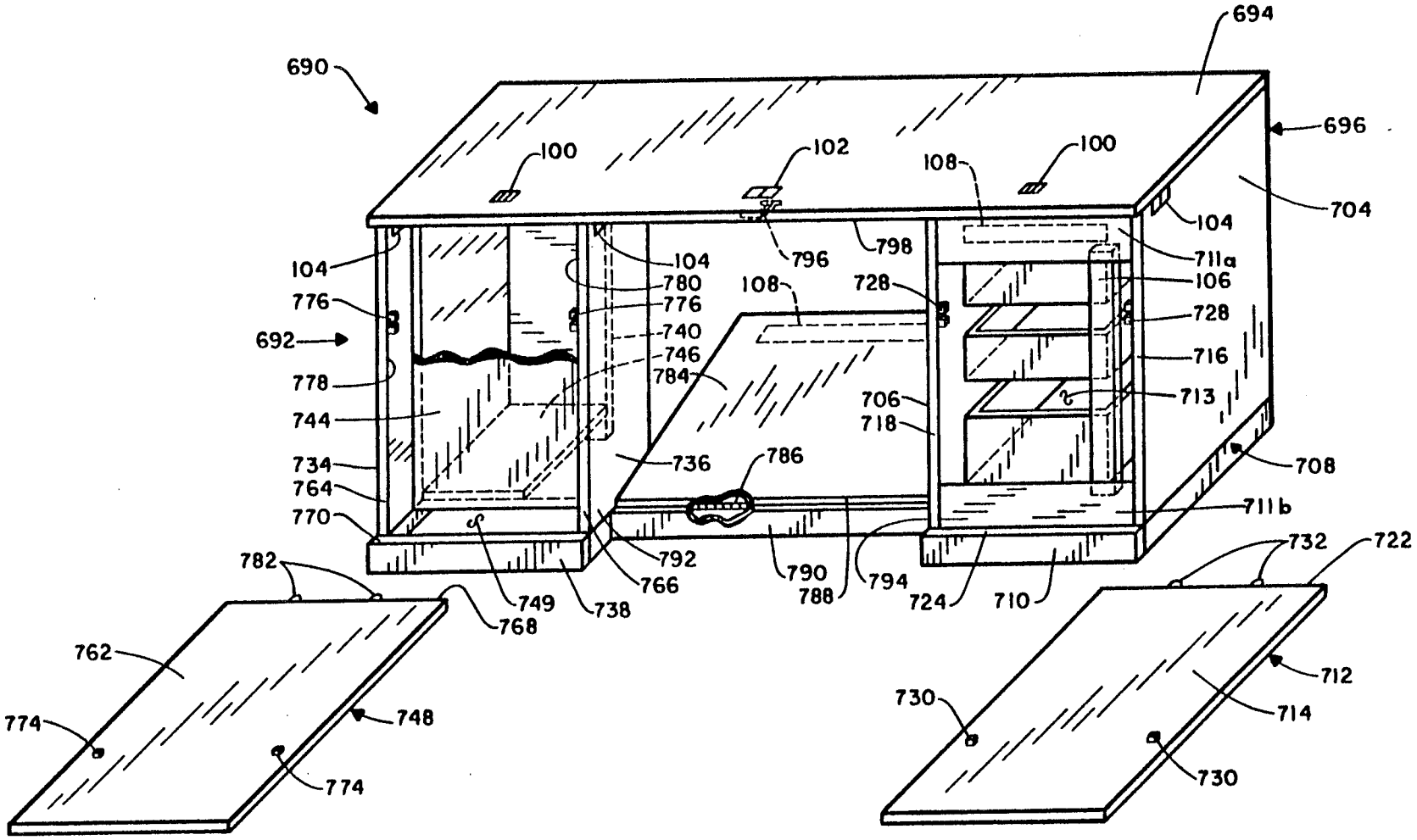
FIG. 26 is a rear perspective view of the desk of FIG. 25 and showing a modesty panel thereof in an open position and a pedestal back thereof having been removed.

Turning now to FIGS. 25 and 26, there is shown a desk 690 having a false pedestal 692. The desk 690 comprises a flat, substantially horizontal, work surface 694, a pedestal 696 supporting one end of the work surface, and the false pedestal 692 supporting the opposite end of the work surface. Drawers 698, 700 and 702 slidably reciprocate into and out of the pedestal 696 on drawer glides or other roller bearing mechanism (not shown separately in the drawings). The pedestal 696 is similar in construction to the pedestal 24 of the desk 12 and includes an exterior wall 704, an interior wall 706 spaced inwardly from the exterior wall, a notched top wall (not shown separately in the drawings), and a removably mounted pedestal back wall 712. The pedestal walls 704, 706 and 712 are supported on an open rectangular base 708 that includes a rear base rail 710. Upper and lower stretchers, respectively, 711*a* and 711*b* extend between and are secured to upper and lower portions of the pedestal walls 704 and 706. There is a cavity 713 between rear edges of the drawers 698, 700, and 702 and the pedestal back wall 712.

The assembly of the pedestal 696 is substantially similar to the pedestal 24 of the desk 12, the pedestals 72 and 74 of the credenza 20, and the pedestals 524 and 526 of the desk 520. Thus, an inside face 714 of the pedestal back 712 is engaged with rear edges 716 and 718, respectively, of the pedestal exterior wall 704 and the pedestal interior wall 706. A bottom edge 722 of the pedestal back wall 712 engages or is closely adjacent to an upper edge 724 of the rear base rail 710. A pair of catches each comprising a female retaining member 728 mounted one each to the exterior and interior pedestal walls 704, 706 and a male locking member 730 mounted to opposite sides of the inside face 714 of the pedestal back 712 are adapted to engage and retain the pedestal back in a closed position. Further, pins 732 analogous to those described above are associated with the bottom edge 722 of the pedestal 696 and the base rail upper edge 724. The pedestal back wall 712 can be positively locked to the pedestal 696 in the manner described hereinabove with regard to the other removably mounted pedestal backs.

The false pedestal 692 comprises an exterior wall 734; a partial interior wall 736 parallel to and spaced inwardly from the exterior wall 734; a base rail 738 spanning between the walls 734 and 736; a sub-wall 740 mounted to a front edge 742 of the exterior wall 734 and extending normally therefrom; a closure panel 744 extending between the exterior and interior walls 734, 736; a shelf 746 mounted to the sub-wall, the closure panel and the exterior wall; and a removably mounted back wall 748. A cavity 749 is established between the pedestal interior and exterior walls 734, 736, the closure panel 744, and the back wall 748 which cavity can also serve as a vertically oriented channel for arranging, distributing and managing cables. The pedestal 692 is referred to as a false pedestal because when fully assembled, the desk 690 when viewed from the rear or guest side of the desk, appears to have a pair of fully outfitted pedestals. However, when the desk 690 is viewed from the front or user side, it can be seen that while the pedestal 696 contains a full complement of drawers 698, 700 and 702, the false pedestal 692 is not so outfitted, although the exterior wall 734, partial interior wall 730, sub-wall 740, closure panel 744 and shelf 746 cooperate to define a storage area 754.

The assembly of the false pedestal 692 is similar to the assembly of the several pedestals described above. The pedestal back 748 includes an inside face 762 that engages rear edges 764 and 766 respectively of the exterior wall 734 and the partial interior wall 736. A bottom edge 768 of the pedestal back 748 engages or is closely adjacent to an upper edge 770 of the base rail 738. Catches comprise a male locking member 774 and a female retaining member 776. The male members 774 are mounted to opposite sides of the inside face 762 of the pedestal back 748. A female member 776 is mounted to both an inside surface 778 of the exterior wall 734 and an inside surface 780 of the partial interior wall 736. In securing the pedestal back 748, the male and female catch members 774 and 776 engage to releasably mount the pedestal back to the pedestal 692. Pins 782 are received within openings (not shown separately in the drawings) found in the upper edge 770 of the base rail 738 and the bottom edge 768 of the pedestal back 748.

As shown in the drawings, the desk 690 can also include a modesty panel 784 pivotally mounted by a continuous hinge 786 to an upper edge 788 of a base rail 790 that extends between an inside surface 794 of the interior wall 706 of the pedestal 696 and an inside surface 792 of the partial interior wall 736 of the false pedestal 692. A spring catch 796 can be mounted to an underside 798 of the work surface 694 to releasably retain the modesty panel 784 in a closed position. The modesty panel 784 is similar to the modesty panel 28 of the desk 12, can be adapted to fully swing both into and away from the knee space as well as be removably mounted. The modesty panel 784 can be mounted to the base rail 790 such that the modesty panel and the base rail move as an integral unit.

5. Wire Management Channels

Figure 27:
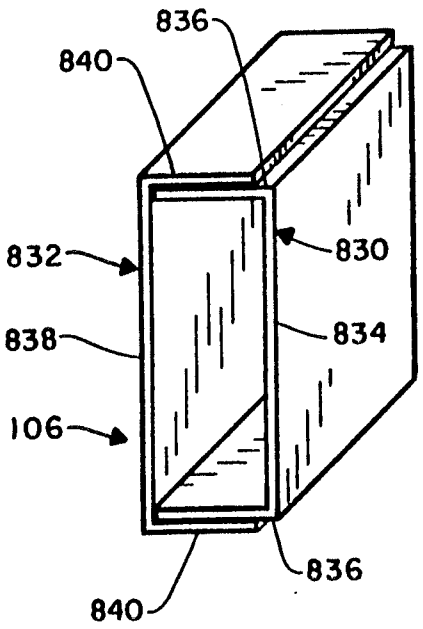
FIG. 27 is a perspective view of a wire management channel of the wire management system.

The wire management channel 106 is best shown in FIG. 27 and comprises an injection molded plastic U- or C- shaped base 830 and an injection molded plastic U- or C- shaped removable cover or cap 832 mounted to the base. The channel 106 is intended for installation interiorly of a pedestal and is oriented in a generally vertical direction. As noted above, the wire management channel 106A is substantially identical to the wire management channels 106B, 106C, and so on, the letters designating different locations for the individual channels within the wire management system 10. The base 830 includes a bottom wall 834 and a pair of parallel, spaced apart legs 836 extending normally from opposite sides of the bottom wall. The cover 832 comprises a top wall 838 and pair of parallel, spaced apart legs 840 projecting from opposite sides of the top wall at substantially right angles therefrom.

In assembly, the bottom wall 834 of the base 830 is mounted to an article of furniture, for example, the interior of the pedestal 24 of the desk 12 by screws, staples, or other appropriate mechanical fasteners. More specifically, each pedestal described hereinabove has a generally similar construction and includes an upper stretcher and a lower stretcher which extend between and are secured to the upper and lower portions of the interior and exterior walls of the pedestal. The wire management channel 106 is preferably secured to the upper and lower stretchers to extend therebetween for the major portion of the interior height of the pedestal. Preferably, the wire management channel is positioned adjacent to either the exterior or interior wall of the pedestal (as opposed to being centered between the same) to avoid obstruction by a floor mounted receptacle or the like, as explained more fully below. The cavity between the rear edges of the pedestal drawers and the pedestal back is of a size sufficient to receive the wire management channel 106. The cables are positioned within the interior of the base 830 and the cover 832 is mounted to the base by frictionally engaging the legs 840 of the cover with the legs 836 of the base, thereby enclosing the cables.

Figure 28:
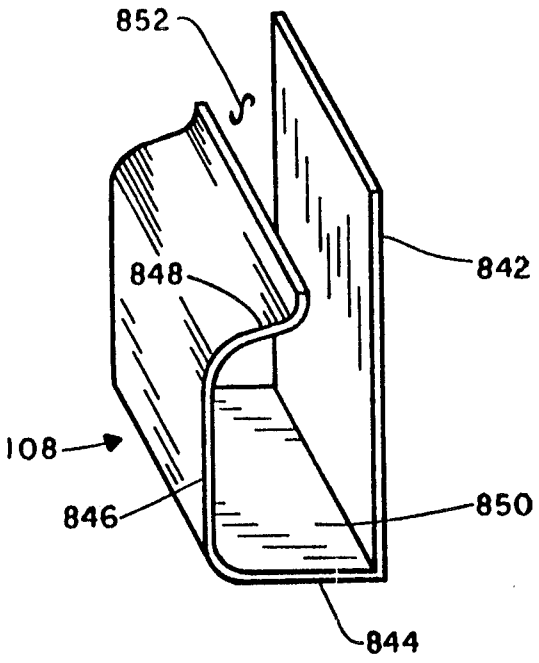
FIG. 28 is a perspective view of a second wire management channel of the wire management system.

As best shown in FIG. 28, the wire management channel 108 is a one piece, injection molded, resilient, substantially J-shaped member. As noted above, the wire management channel 108A is substantially similar to the wire management channels 108B, 108C and so on, the letters designating various locations for the individual channels within the wire management system 10.

The channel 108 comprises a mounting surface 842, a bottom wall 844, a return leg 846, and an inwardly directed flange 848 contiguous with the return leg. Thus, the channel 108 includes a cable receiving section 850 and a narrow neck 852 that is in communication with the cable receiving section. In assembly, the channel 108 is mounted to an article of furniture, for example the desk 12, by securing the bottom wall 844 to the interior surface 500 of the desk modesty panel 28 and adjacent the top edge 486 thereof with an appropriate fastener such as screws, staples or double-sided adhesive tape. In general, the wire channel 108 is mounted to the inside surface of a modesty panel, the upper stretcher of a pedestal, the panel-like legs of a component table, the inside surface of a false pedestal exterior wall, or other similar surface in which it would be desirable to have the ability to transport wires horizontally. When mounted interiorly of a pedestal, it is preferred that the wire management channel 108 be installed beneath both the underside of the furniture article work surface and the underside of the pedestal top wall. It is preferred that the channel 108 be oriented in a substantially horizontal direction with the cable receiving section 850 and the neck 852 opening upwardly. The return leg 846 and the flange 848 are resilient and can be displaced relative to the mounting surface 842 thereby increasing the size of the neck 852 to allow for the passage of cables through the neck to the cable receiving section where they are retained.

6. A Freestanding Furniture System Having Wire Management

Turning again to FIGS. 1 to 4, the arrangement of the several articles of furniture having the wire management system 10 will be described. Of course it will be understood that each article of furniture shown in FIGS. 1 to 4, namely the desk 12, the component tables 14 and 16, the bridge 18, and the credenza 20, have been provided with grommets, wire management channels, removable pedestal backs or pivoting modesty panels as the case may be and that each article of furniture (with perhaps the exception of the bridge 18) may be used alone and without any other article of furniture. Thus, each article of furniture is provided with its own independent wire management system. However, the furniture articles also include elements of the wire management system, namely the grommets 104, that allow for electrical and communication cables to be efficiently arranged and distributed from one furniture article to an adjacent article.

It will also be understood that although a particular arrangement of furniture articles is illustrated in FIGS. 1 to 4, an innumerable variety of furniture arrangements is possible using the articles shown in FIGS. 1 to 4 as well as the other articles described hereinabove. The arrangement of FIGS. 1 to 4 is provided to show a typical configuration that makes use of the various elements of the wire management system 10.

Thus there is shown a conventional floor mounted double duplex electrical receptacle 900 positioned below the pedestal 24 of the desk 12. Cables 902, 904, 906 and 908 are electrically connected to the receptacle 900 and are carried vertically through the wire management channel 106A secured to the pedestal stretchers 576 and 580. The open base 562 facilitates running cables interiorly of the pedestal 24. Further, because an open pedestal base is provided, the desk 12 may be positioned such that the receptacle 900 is received within the interior of the pedestal. Thus, the cables 902, 904, 906 and 908 can be extended directly into the pedestal interior and the wire management channel 106A. Also, as noted hereinabove, by mounting the wire management channel closely adjacent to the exterior wall 560 of the desk pedestal 24, the channel does not interfere with the placement of the pedestal over the receptacle 900.

The cable 902 exits from a top end of the channel 106A and is routed through the notch **563*a* in the pedestal top wall 563 and then through the wire management channel 233 of the grommet 100A to the desk top 22, the pivoting wire access arm 226 of the grommet having been elevated. The cable 902 supplies power to the calculator 112. The cables 904, 906 and 908 exit from the top end of the channel 106A, pass through the notch 563*a* in the pedestal top wall 563 lay in the wire management channel 108A mounted to the upper stretcher 576 interiorly of the desk pedestal 24, extend through the grommet 104B mounted to the interior wall 34 of the pedestal 24, and are received by the wire management channel 108B mounted to an interior surface 500 of the desk modesty panel 28. Preferably, the wire management channels 108A and 108B and the grommet 104B are aligned to facilitate distribution of the cables. It should be noted that the notch 563*a* in the pedestal top wall 563 also facilitates cable access to the grommets 104** mounted to the pedestal side walls.

The cables 904 and 906 are routed through the wire access opening 370 in the grommet 102A mounted in the desk top 22 to supply, respectively, the dictaphone 114 and the desk lamp 116. The size of the wire access opening of the grommet 102B can be enlarged if necessary by removing the removable sections 374 or by removing the covers 282, as described hereinabove. The cable 908 is extended through the length of the wire management channel 108B, exits from an opposite end thereof, and is passed through the grommet 104C mounted to the desk return panel 26. The cable 908 is further passed through the grommet 104D mounted to the leg 46 of the component table 14 and into the wire management channel 108C mounted to an inside surface of the leg 48. Preferably the grommets 104C and 104D are aligned with the wire management channels 108B and 108C to facilitate distribution of the cable 908. The cable 908 may be brought to the upper component supporting surface 44 of the table 14 and connected to the computer 118 thereon by passing the cable through the wire access opening 370 in the grommet 102B mounted to supporting surface 44. Of course, the size of the wire opening 370 may be expanded as described herein above.

A communications jack 910 is mounted on the floor below the knee space 41 for the desk 12 and a communications cable 912 extending therefrom may be connected to the telephone 110 by running the cable 912 through the wire management channel 233 of the desk top grommet 100B.

A similar arrangement of cables is associated with the credenza 20. Thus, a double duplex receptacle 914 is mounted to the floor beneath the pedestal 72, this being facilitated by the open pedestal base 660. Cables 916, 918, 920 and 922 extend therefrom through the wire management channel 106B mounted to and between the upper and lower stretchers **641*a* and 641*b* and exit from a top end thereof. The cable 916 is routed through the grommet 100C to power the lamp 124 while the cables 918 and 920 are laid in the wire management channel 108H mounted to the upper stretcher 641*a*. The cables 918 and 920 exit from the opposite end of the channel 108H and are passed through the grommet 104I mounted to the inside wall 78 of the pedestal 72 to eventually be received by the wire management channel 108I mounted to the inside surface 84 the credenza modesty panel 76. The cable 918 is brought to the credenza upper surface 70 by the passing it through the grommet 102E where it powers the stereophonic equipment 128. The cable 920 extends the length of the wire management channel 108I, passes through the grommet 104J mounted to the inside wall 80 of the pedestal 74, and is routed to the credenza top 70 through the grommet 100D. The cable 920 is connected to the lamp 126**.

The cable 922 also exits from the top of the wire management channel 106B but is branched through the grommets 104H and 104G, respectively mounted to the outside wall 648 of the credenza pedestal 72 and the support leg 68 of the component table 16. The cable 922 traverses the length of the wire management channel 108G and is eventually connected to the electric typewriter 122 after being passed through the grommet 102D mounted to the work surface 60 of the component table 16. Preferably the grommet 104K (mounted to the outside wall of the pedestal 74), the wire management channel 108J (mounted interiorly of the pedestal 74), the grommet 104J, the wire management channel 108I, the grommet 104I, the channel 108H, the grommets 104H and 104G, and the wire management channel 108G are aligned to facilitate the distribution of cables.

Thus it can be seen that an efficient and effective wire management system for articles of furniture used either individually or in conjunction with other articles of furniture has been provided. The wire management channels 106 and 108 allow for organized and coordinated distribution and transport of electrical and communications cables. The cables are neatly arranged and hidden from view yet entirely accessible when needed. The grommets 100 and 102 mounted in generally, flat, horizontal upper work surfaces and the like allow for distributing the various cables to the work surfaces and the office equipment associated therewith, thereby preventing an unsightly and cluttered accumulation of cables that can otherwise occur. The grommets 104 assist in distributing cables from one side of an article of furniture to an opposite side and also in passing cables from an article of furniture to an adjacent article. The distribution of the cables is further facilitated by the aligned orientation of the grommets 100, 102, 104 and the wire management channels 106 and 108. Extension of cables through an article is made particularly easy by the alignment of the grommets 104 with the wire management channels 106 and 108. Alignment of the grommets 100 and 102 with the grommets 104 and the wire management channels facilitates the provision of the electrical and communications utilities to the various work surfaces. A maze of cables snaking across floors and work surfaces to supply electrical and communications devices remote from receptacles is eliminated with the grommets and wire management channels according to the invention.

Similarly, the pivoting modesty panels enhance the ability to configure furnishings because receptacles positioned behind a desk, credenza or the like, which, heretofore, have been accessible only with great effort by moving the often quite heavy furniture articles, are now easily accessible. Furthermore, the furniture articles can be placed directly adjacent to a wall having electrical or communications receptacles mounted thereto. Cables extending from the receptacle can be brought into the wire management system by removing a removably mounted pedestal back. The cables can then be laid in the various vertical and horizontal wire management channels 108 and 106, brought through the grommets 100 and 102 to work surfaces to supply equipment, or routed through the furniture article to an adjacent article. To pass cabling through a pedestal for example, the cable need only be inserted through the grommet 104 mounted to the pedestal interior wall and either brought to the work surface or withdrawn through the grommet 104 mounted to the pedestal exterior wall. In either case, the process is facilitated by the removable pedestal backs which allow for quick and easy access to the pedestal interior and the cables routed therein. Because the pedestal backs according to the invention are removable, wall mounted receptacles are fully accessible and the cables extending therefrom can remain hidden but easily configurable. If the furniture article is positioned such that a wall mounted receptacle is adjacent to a modesty panel according to the invention the cables are still accessible. The modesty panel need only be pivoted into the knee space thereby exposing the receptacle. Cables extending from the receptacle can then be accessed and routed interiorly of the furniture article and through the wire management system by removing the back of a pedestal adjacent to the modesty panel and extending the cables into the pedestal interior.

Reasonable variations or modifications are possible within the spirit of the foregoing specification and drawings without departing from the scope of the invention which is defined in the accompanying claims.

The embodiments of the invention in which an exclusive property or privilege is claimed are defined as follows:

1. An article of furniture having a generally horizontal work surface, said article comprising a top having front and rear sides and opposite ends, a member depending from said top, and a panel pivotably mounted to said member adjacent said rear side of said top for movement between a first position wherein said panel restricts access to space rearward of said article from a position beneath said top and a second position wherein said panel permits access to space rearward of said article from a position beneath said top, said panel being movable in a direction toward said front side of said article as said panel is pivoted toward said second position.

2. An article of furniture according to claim 1 wherein said member is a support member for said top, said support member at least partially defining a knee space beneath said top and between said opposite ends thereof, said panel partially defining said knee space when said panel is in the first position and pivotable into said knee space as said panel is pivoted toward said second position.

3. An article of furniture according to claim 2 wherein said support member is mounted adjacent to one of said opposite ends of said top, said article further comprising a rail mounted on said support member and extending between said opposite ends of said top beneath the same, said panel being pivotably mounted to said rail for pivotable movement between said first and second positions.

4. An article of furniture according to claim 3 and further comprising a latch for releasably fastening said panel in said first position.

5. An article of furniture according to claim 4, wherein said latch is mounted on said top.

6. An article of furniture according to claim 3 wherein two of said support members are mounted to said top at said opposite ends thereof, said knee space being at least partially defined by and between said support members, said rail being mounted to and between said support members at lower portions thereof.

7. An article of furniture according to claim 6 wherein at least one hinge is mounted to and between said rail and said panel to effect pivotable movement of said panel into said knee space between said first and second positions of said panel.

8. An article of furniture according to claim 7 and further comprising a latch for releasably fastening said panel in said first position.

9. An article of furniture according to claim 8, wherein said latch is mounted on said top.

10. In a grommet for an article of furniture having an interior space and a panel separating the interior space of said article from the exterior thereof, said panel having an opening therein for communication between the interior and exterior, said grommet being adapted to be received in said opening, the improvement in said grommet comprising:

a sleeve adapted to be received within the opening; and a cover removably mounted to the sleeve to cover the opening, said cover comprising a closure member pivotally mounted thereto, said closure member having a pair of opposed walls connected by a web thereby defining a channel for conducting wires therethrough between the interior and the exterior.

11. In a grommet for an article of furniture having an interior space and a panel separating the interior space of said article from the exterior thereof, said panel having an aperture therein for communication between the interior and exterior, said grommet being adapted to be received in said aperture, the improvement in said grommet comprising:

a sleeve having a passage therethrough, said sleeve being adapted to be received within the aperture; and a cover removably received within the sleeve to at least partially cover the passage, said cover having a top wall and a recessed base wall spaced from the top wall by a side wall, said base wall and said side wall at least partially defining an opening beneath the top wall and substantially concealed from view thereby to permit wires to pass therethrough between the interior and the exterior when the grommet is received within the aperture.

12. A grommet according to claim 11 wherein the cover has a wall portion complementary in shape to the sleeve and adapted to be slidably received within the sleeve.

13. A grommet according to claim 12 wherein a portion of said sidewall is offset from the remainder of said sidewall and said offset portion partially defines said opening.

14. A grommet according to claim 13 wherein the recessed base wall includes a section removably connected thereto adjacent the contiguous opening whereby the contiguous opening can be enlarged when the section is removed.

15. A grommet according to claim 14 wherein the section is connected to the recessed portion by a frangible connection.

16. An article of free standing furniture having a generally horizontal work surface, the article comprising:

a horizontal panel supported by two support members and a vertical panel extending therebetween, said horizontal panel, vertical panel and support members at least partially defining an interior space and separating said interior space of the article from the exterior thereof; and wire management means for conducting electrical wires to electrical components associated with said article, said wire management means comprising a grommet mounted to the horizontal panel and defining an opening therethrough for communication between the interior space and the exterior and a channel mounted within the interior space to one of the vertical panel and the horizontal panel substantially in registry with the grommet;

said vertical panel being mounted to the support members for pivotable movement into the interior space.

17. An article of furniture according to claim 16 wherein the grommet comprises a sleeve mounted to said panel and defining the opening therethrough; and a cover removably mounted to the sleeve to cover the opening.

18. An article of furniture according to claim 17 wherein the cover comprises a closure member pivotally mounted thereto, said closure member having a pair of opposed walls connected by a web thereby defining a channel for conducting wires therethrough.

19. An article of furniture according to claim 17 wherein the cover has a wall portion complementary in shape to the sleeve and adapted to be slidably received within the sleeve.

20. An article of furniture according to claim 19 wherein the cover comprises a recessed portion connected angularly to a first wall, said first wall and said recessed portion having a contiguous opening to form the opening means.

21. An article of furniture according to claim 20 wherein a portion of said first wall is offset from the remainder of said first wall and said offset portion partially defines said contiguous opening.

22. An article of furniture according to claim 21 wherein the recessed portion includes a section removably connected thereto adjacent the contiguous opening whereby the contiguous opening can be enlarged when the section is removed.

23. An article of furniture according to claim 22 wherein the section is connected to the recessed portion by a frangible connection.

24. An article of furniture according to claim 21 wherein the cover comprises a second wall angularly connected to said first wall at said offset portion and spaced from said contiguous opening to partially define the opening means and substantially conceal the opening means from view when the cover is mounted to the sleeve.

25. An article of furniture according to claim 16 further comprising a latch for releasably fastening the panel in the first position.

26. A grommet for conducting electrical wiring from the interior of an article of furniture to the exterior thereof, said grommet comprising:

a sleeve having a passage therethrough along an axis;

a cover having a wall partially defining an opening therein, said cover being removably received within the sleeve with the wall substantially normal to the axis and thereby at least partially covering the passage; and a member extending from said wall adjacent to the opening so that the member and the opening can be oriented relative to the sleeve, about the axis, to at least partially obscure the opening from view without obstructing the opening into the passage.

27. A grommet according to claim 26 wherein the member is pivotally mounted to the wall.

28. A grommet according to claim 26 wherein the wall is recessed in the cover, and the member extends above and over the opening.

29. A grommet according to claim 26 wherein the wall includes a section removably connected thereto adjacent the opening.

30. A grommet according to claim 29 wherein the section is connected to the wall by a frangible connection.

* * * * *